US006892497B2

(12) United States Patent
Moon et al.

(10) Patent No.: US 6,892,497 B2
(45) Date of Patent: May 17, 2005

(54) PLASTIC PANEL ENCLOSURE SYSTEM

(75) Inventors: Brian Moon, Dekalb, IL (US); Michael Uffner, Naperville, IL (US)

(73) Assignee: Suncast Corporation, Batavia, IL (US)

( * ) Notice: Subject to any disclaimer, the term of this patent is extended or adjusted under 35 U.S.C. 154(b) by 15 days.

(21) Appl. No.: 10/404,281

(22) Filed: Mar. 31, 2003

(65) Prior Publication Data

US 2004/0187402 A1 Sep. 30, 2004

(51) Int. Cl.[7] ..... E04H 5/00

(52) U.S. Cl. ..... 52/79.1; 52/270; 52/284; 52/589.1

(58) Field of Search ..... 52/79.1, 79.5, 52/264, 270, 284, 585.1, 589.1, 592.1, 578; 446/110

(56) References Cited

U.S. PATENT DOCUMENTS 4,570,392 A * 2/1986 Oltman et al. ..... 52/64
4,914,874 A * 4/1990 Graham, Jr. ..... 52/79.1
5,619,826 A * 4/1997 Wu ..... 52/35
5,647,177 A * 7/1997 Hwang ..... 52/79.5
5,682,622 A * 11/1997 Tagg ..... 4/449
5,706,613 A * 1/1998 Drake et al. ..... 52/79.1
6,115,971 A * 9/2000 Loebertmann et al. ..... 52/79.1
6,250,022 B1 * 6/2001 Paz et al. ..... 52/79.5
6,418,672 B1 * 7/2002 Hampel ..... 52/79.1
6,581,337 B1 * 6/2003 Skov et al. ..... 52/79.5
6,701,678 B1 * 3/2004 Skov et al. ..... 52/79.9
2003/0140573 A1 * 7/2003 Marcinkowski et al. ..... 52/79.5

* cited by examiner

*Primary Examiner*—Brian E. Glessner
(74) *Attorney, Agent, or Firm*—McHale & Slavin, P.A.

(57) ABSTRACT

The present invention provides a system, or kit, of injection molded panels having integrated connectors which combine to form an enclosure, commonly in the form of a utility shed. The bilaterally symmetrical panels are formed of injection molded plastic to interlock with one another without the need for separate I-beam connectors. The ends of the wall panels have cavities to accept both roof and floor outwardly projecting interlocking posts for interlocking cooperative engagement which serve to rigidly connect the components together. The bilateral symmetry of the wall, roof, floor and door components also minimizes component shapes and simplifies enclosure construction.

27 Claims, 23 Drawing Sheets

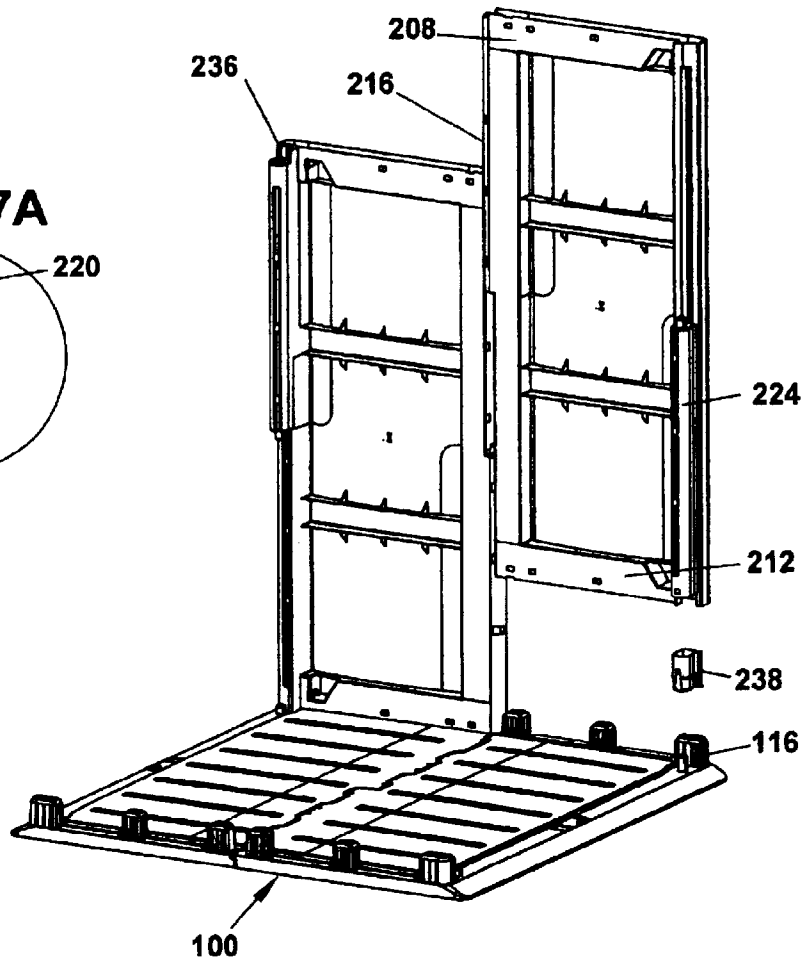
FIG. 8
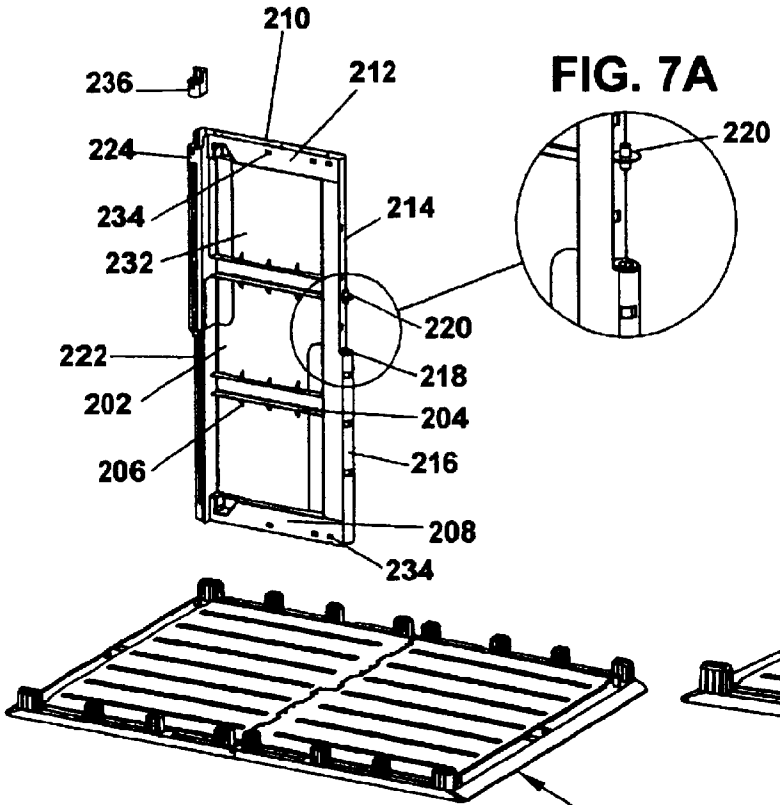
FIG. 7A
FIG. 7

PLASTIC PANEL ENCLOSURE SYSTEM

FIELD OF THE INVENTION

This invention relates generally to an enclosure constructed of plastic structural panels. More specifically, the present invention relates to a modular construction system utilizing injection molded plastic structural panels having integrated connectors to construct variably sized storage sheds using the same components.

BACKGROUND INFORMATION

Enclosures such as storage sheds are a necessity for lawn and garden care, as well as general all-around home storage space. Typically, garden tools and equipment are found either stacked into a corner of the garage, or bundled together and covered with a tarpaulin to protect them from the elements. During the off-seasons, lawn mowers, tillers and snow equipment often consume the available floor space of a garage, forcing the homeowner to park his automobile outside.

The prior art has proposed a number of different panel systems, or kits comprising blow molded or extruded panels and connector members for forming a wide variety of structures. Due to manufacturing limitations blow molded and extruded plastic components cannot be formed with the integral cross-bracing ribs or the intricate shapes and sharp corners required for integrated connectors that are possible with injection molding. Typically, such systems require extruded metal or plastic connector members having a specific cross-sectional geometry that facilitate an engagement between such members and one or more plastic panels having a complimentary edge configuration.

A particularly common structure for the connector members is the I-beam cross section. The I-beam defines free edge portions of the connector member which fit within appropriately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective wall panel and thereby serve to join such panels together at right angles. Straight or in-line versions of the connector members are also included in the kits to join panels in a coplanar relationship to create walls of varying length.

Extruded components generally require hollow longitudinal conduits for connection and strength. Due to the nature of the manufacturing process the conduits are difficult to extrude in sections long enough for structural panels. Thus, they require connectors to achieve adequate height for utility shed walls. A common structure for connecting extruded members has a center I-beam with upper and lower protrusions for engaging the conduits. However, wall panels utilizing I-beam connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length. The protrusions are situated to slidably engage the conduits located in the side panel sections to create the height needed for utility shed walls.

The aforementioned systems can also incorporate roof and floor panels to form a freestanding enclosed structure such as a utility shed. U.S. Pat. Nos. 3,866,381; 5,036,634; and 4,557,091 disclose various systems having inter-fitting panel and connector components. Such prior art systems, while working well, have not met all of the needs of consumers to provide structural integrity combined with modularity and aesthetic appearance. Paramount among such needs is a panel system which eliminates the need for I-beam connectors creating enclosure walls which resist panel separation, buckling, racking and weather infiltration. It is also desirable for the wall formed by the panels to tie into the roof and floor in such a way as to unify the entire enclosure. Also, from a structural standpoint, a door must be present which can be easily installed after assembly of the wall and roof components, is compatible with the sidewalls, and provides dependable pivoting door access to the enclosure. All known prior art requires the roof to be partially disassembled before the doors can be installed.

There are also commercial considerations that must be satisfied by any viable enclosure system or kit; considerations which are not entirely satisfied by state of the art products. The enclosure must be formed of relatively few component parts that are inexpensive to manufacture by conventional techniques. The enclosure must also be capable of being packaged and shipped in a knocked-down state. In addition, the system must be modular and facilitate the creation of a family of enclosures that vary in size but share common, interchangeable components.

Finally, there are ergonomic needs that an enclosure system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from the internal storage volume of the resulting enclosure or otherwise detract from the internal storage volume of the resulting enclosure or otherwise negatively affect the utility of the structure.

BRIEF DESCRIPTION OF THE INVENTION

The present invention provides a system, or kit, of injection molded panels having integrated interlock connectors which combine to form an enclosure, commonly in the form of a utility shed. The bilaterally symmetrical panels are formed of injection molded plastic to interlock with one another without the need for separate I-beam connectors. The ends of the wall panels have sockets to accept both roof and floor outwardly projecting interlocking posts for cooperative engagement which serves to rigidly connect the components together.

The system incorporates a minimum number of components to construct a heavy duty enclosure by integrally forming the connectors into the injection molded panels. This minimizes the need for separate extruded or molded connectors to assemble the enclosure. The bilateral symmetry of the wall, roof, floor and door components also minimizes component shapes and simplifies enclosure construction. Injection molding the wall panels allows them to be formed with adequate height for a walk-in enclosure, eliminating the need for stacking panels to achieve such a height. Injection molding also allows the panels to be formed with integral cross-bracing, ribs and gussets for increased rigidity when compared to blow molded or extruded panels.

In one embodiment, the enclosure system utilizes two types of wall panel construction: the first being utilized for the side walls, and the second being used for the rear wall and the door assembly. The embodiment also utilizes one construction of bilaterally symmetrical roof panel and one construction of bilaterally symmetrical floor panel; each of the assemblies having a median axis of symmetry with one panel on each side of the axis rotated 180° in relationship to the other. The system further includes a door assembly which slides into place after the walls and roof have been fully assembled. The floor of the system is constructed to allow optional plastic floor supports or wooden floor joists to be added to the plastic floor panels, and optional steel supports to be added to the roof panels further increasing the structural integrity of the enclosure. The same components are used to create sheds of varying size. The assembly of the system requires minimal hardware and a minimum number of hand tools.

Accordingly, it is an objective of the present invention to provide a modular panel system having integrated interlocking connectors for creating enclosures of varying dimension using common components.

A further objective is to provide a modular panel system with integrated interlocking connectors which accommodates injection molding plastic formation of the panel components for increased structural integrity.

Yet a further objective is to provide a modular panel system enclosure in which sides, roof, and floor are integrally interlocked without I-beam connectors.

Another objective is to provide an enclosure constructed of modular panels having a door assembly which allows door installation after all other parts are assembled.

Yet another objective is to provide a modular panel system which reduces the number of components required to assemble an enclosure and simplifies construction.

Still yet another objective is to provide a heavy duty enclosure constructed of modular panels constructed and arranged to allow wood, plastic or steel supports to be easily incorporated into the panels.

An even further objective is to provide an enclosure kit for a utility shed in which modular panels are provided to the consumer in a disassembled state.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE FIGURES

FIG. 7 is a partial perspective view illustrating assembly of the first side wall panel to the floor assembly;

FIG. 7A is a partial enlarged view illustrating the cooperative engagement between the panels and the dowel;

FIG. 8 is a partial perspective view further illustrating assembly of the side wall panels;

DETAILED DESCRIPTION OF THE PREFERRED EMBODIMENTS

Figure 1:
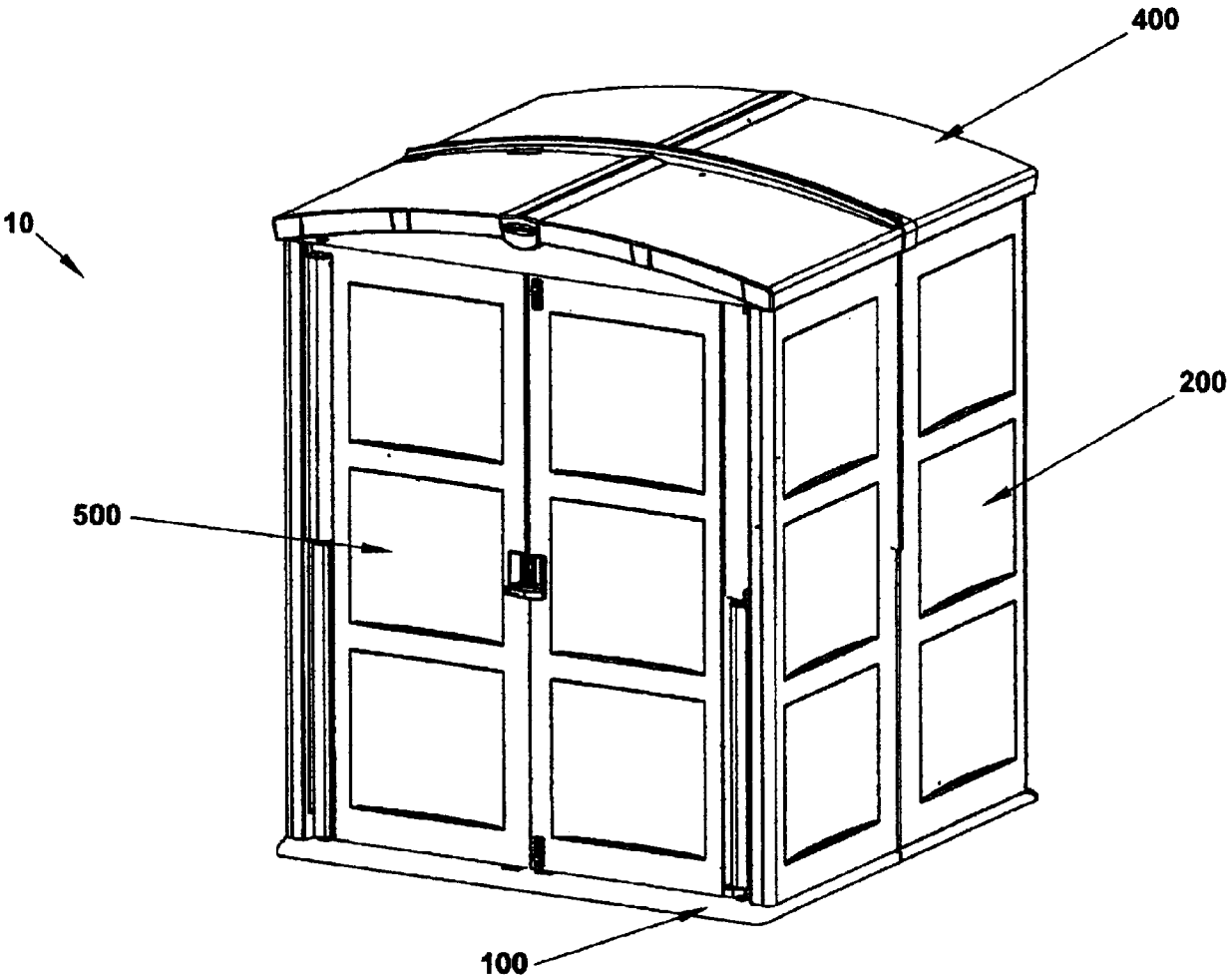
FIG. 1 is a perspective view of an enclosure constructed using the instant enclosure system.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
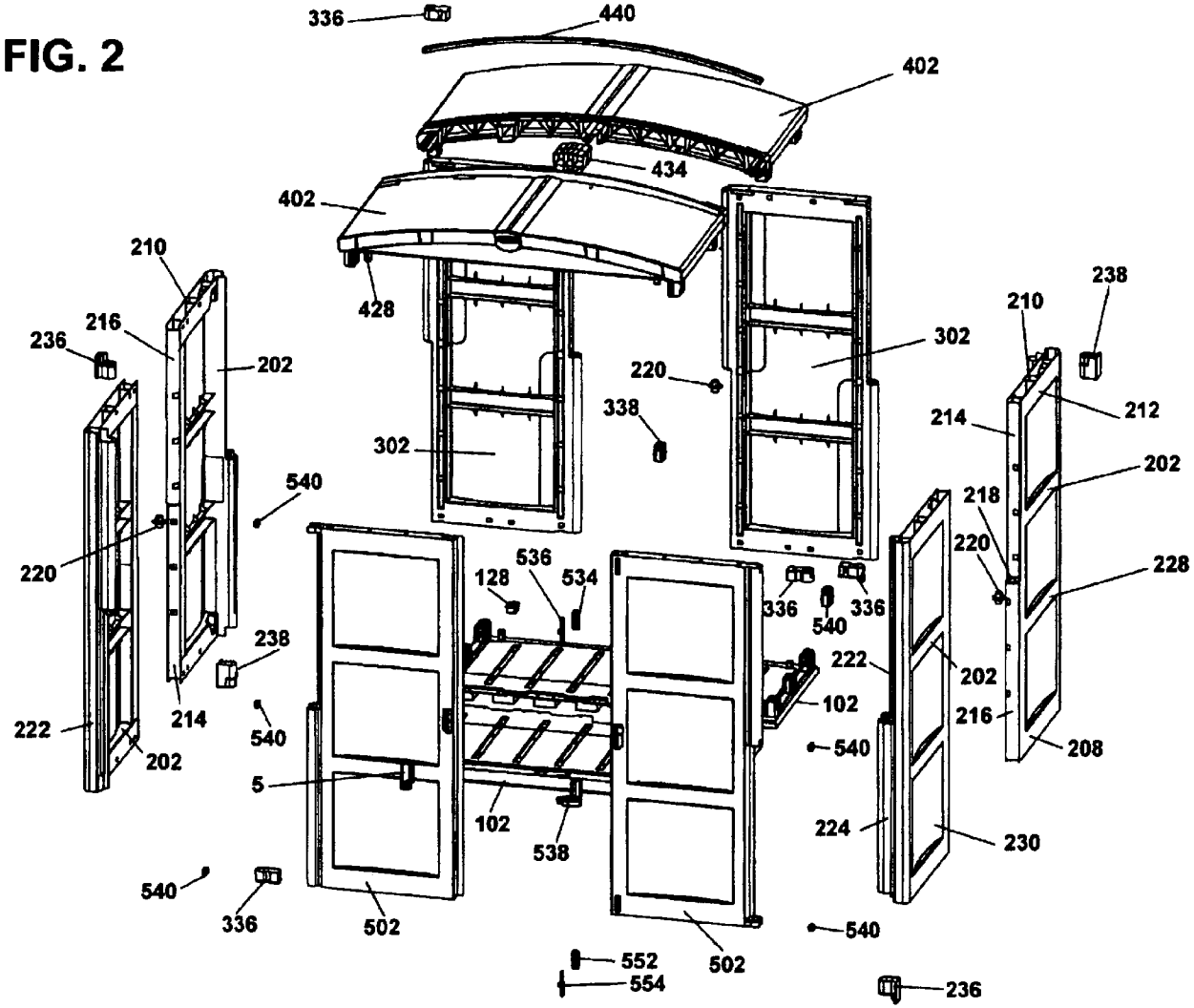
FIG. 2 is an exploded view of the enclosure shown in FIG. 1.

FIGS. 1 and 2 which are now referenced show an isometric and exploded view of the heavy duty enclosure, generally referenced as 10, according to a preferred embodiment of the present invention. The enclosure is made up of a floor assembly 100, left and right side wall assemblies 200, rear wall assembly 300, roof assembly 400 and door assembly 500. In the preferred embodiment, the panels comprising the assemblies are formed of, but not limited to, a suitable plastic such as polypropylene, through the process of injection molding. The result is that the panels comprising the floor 100, walls 200–300, roof 400, and doors 500 of the enclosure 10 are formed as unitary panels with integral interlocking connectors, and cross bracing. Strengthening ribs 202 and gussets 204 are formed within the inner surfaces of the wall panels 200–300 in order to enhance rigidity of the panels while leaving the external surface in a generally smooth condition for aesthetic purposes, as shown in FIG. 1. The panels are utilized to construct the bi-laterally symmetrical floor assembly 100, left and right wall assemblies 200, rear wall assembly 300, door assembly 500, and roof assembly 400 using a minimal number of components.

Figure 3:
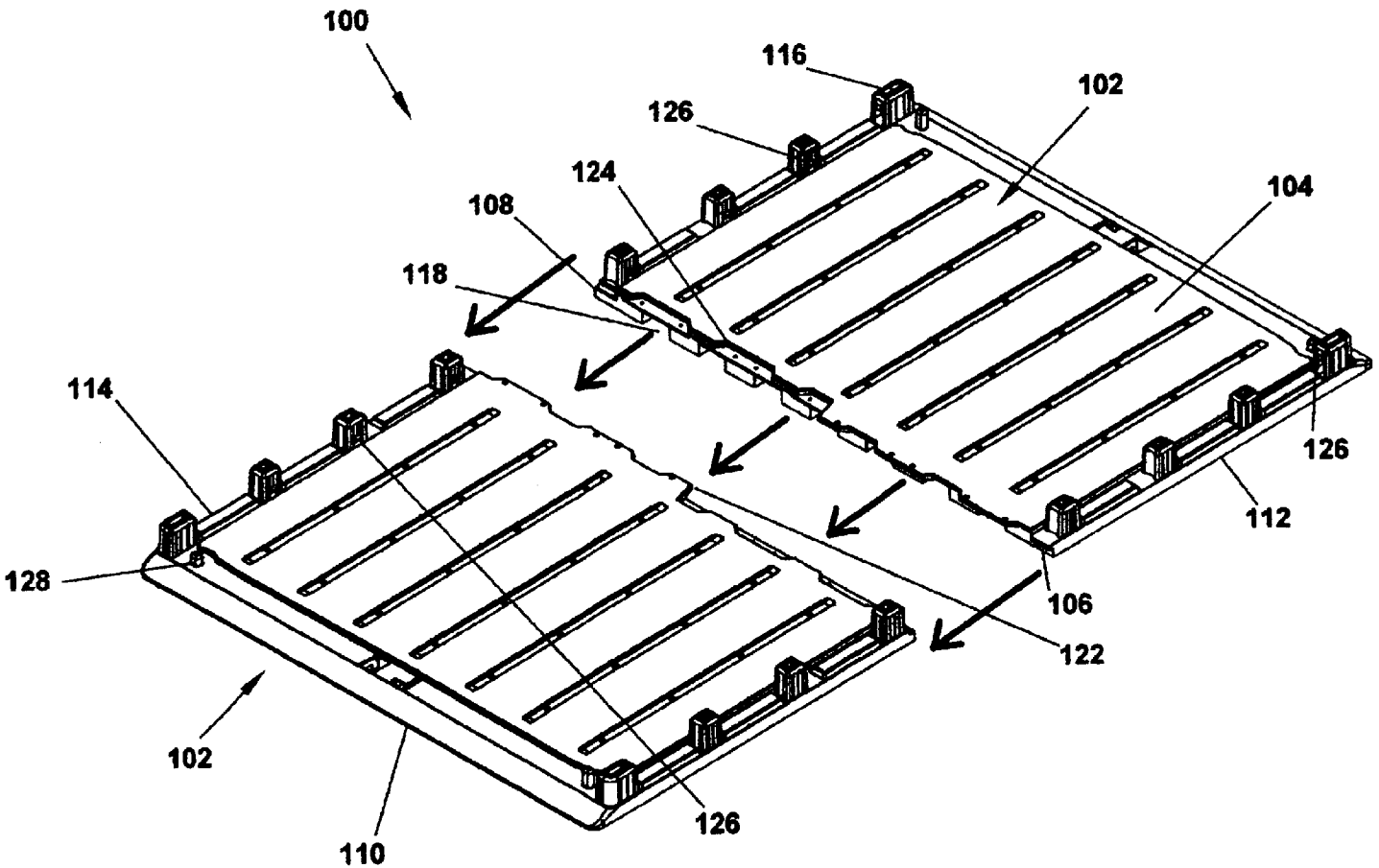
FIG. 3 is a perspective view of one embodiment of the floor assembly utilized in the instant invention.
Figure 4:
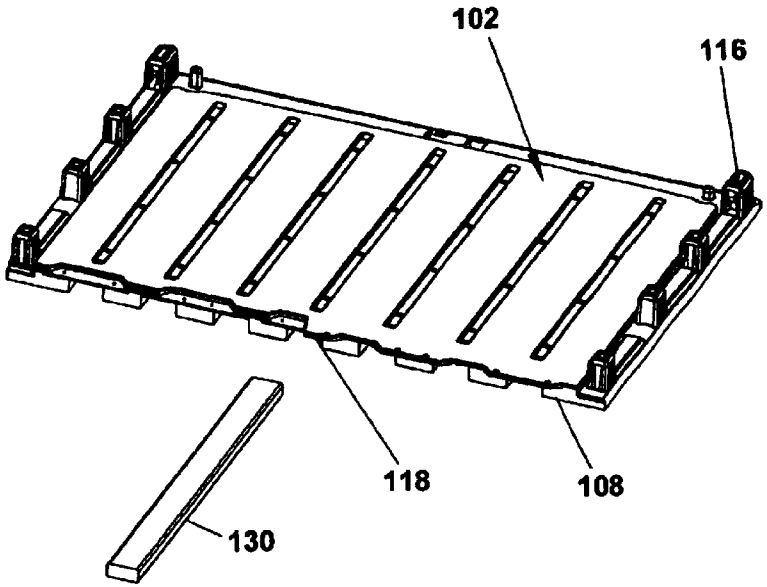
FIG. 4 is a partial perspective view of the floor assembly illustrating insertion of the optional plastic floor supports.
Figure 4A:
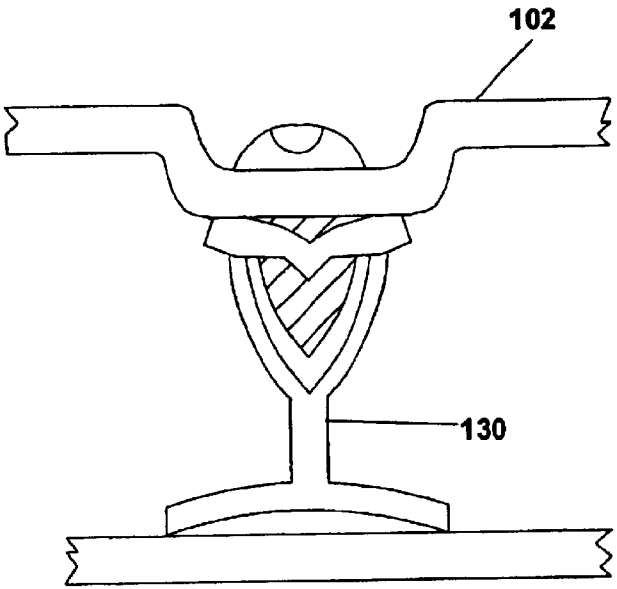
FIG. 4A is a cross-sectional view along lines 1—1 of FIG. 4 illustrating the cooperation between the floor panel and the plastic floor supports.
Figure 5A:
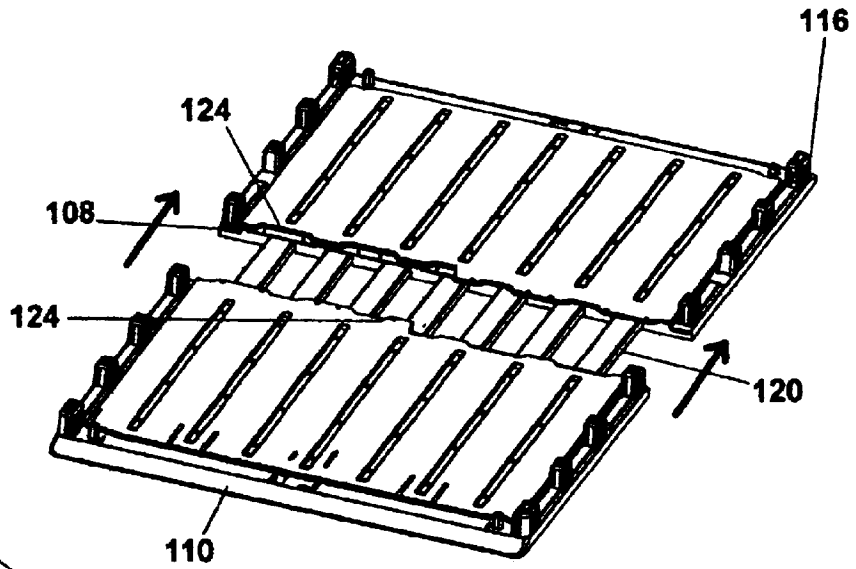
FIG. 5A is a perspective view of the floor assembly illustrating the sliding engagement of the floor panels.
Figure 5:
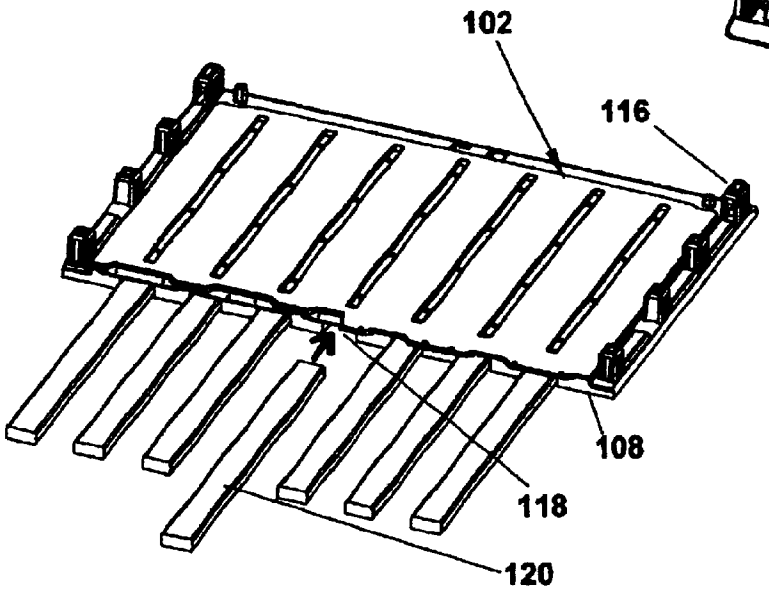
FIG. 5 is a partial perspective view of the floor assembly illustrating the insertion of the optional floor joists.
Figure 6:
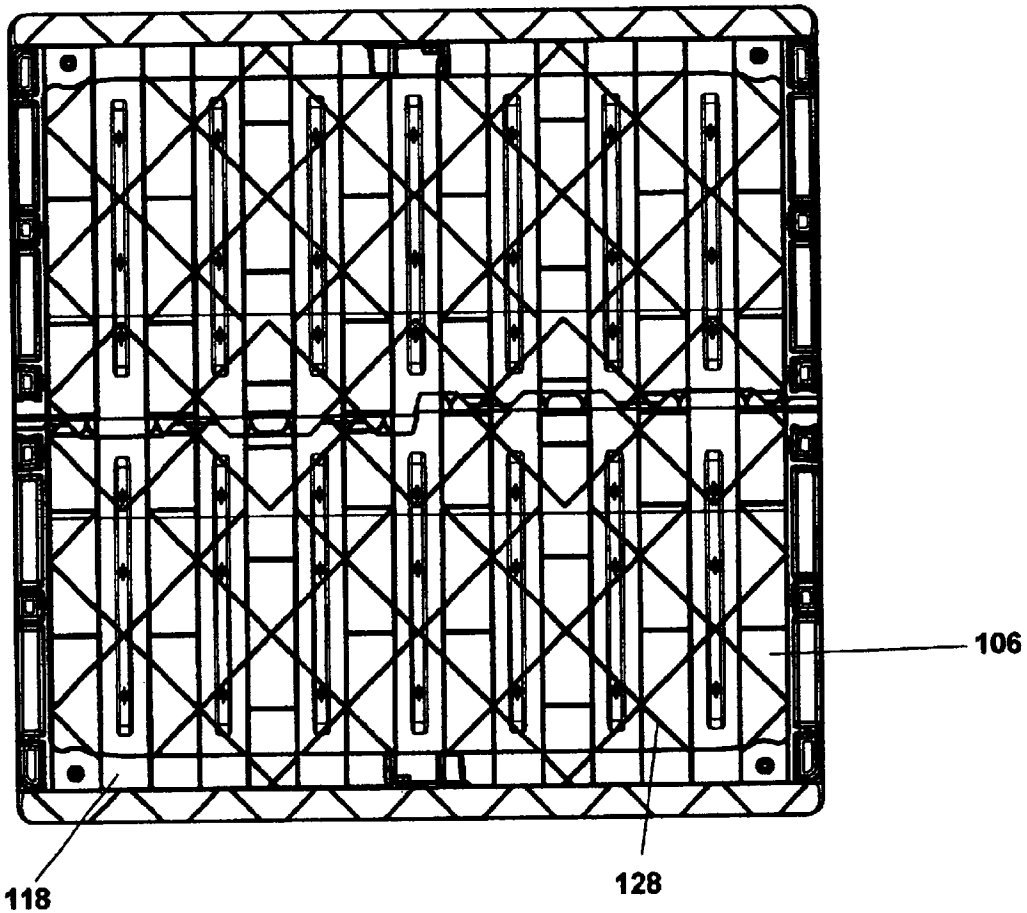
FIG. 6 is a bottom view of the floor assembly illustrating the cross-bracing.

Referring to FIGS. 3–7, the enclosure includes a pair of like-constructed floor panels 102. Each panel has a top surface 104, bottom surface 106, locking edge 108, ramp edge 110, and two closed edges 112 and 114. Adjacent to each of the closed edges is a means of attaching the floor assembly to the wall assemblies illustrated as a plurality of interlocking posts 116 extending upwardly from the top surface 104. The interlocking posts 116 are constructed and arranged to cooperate with sockets 210 located at each longitudinal end of the first structural wall panels 202. Adjacent to each of the ramp edges 110 is a pair of generally cylindrical hinge pins 128 extending upwardly. The hinge pins 128 cooperate with the panels 502 to allow rotational movement. A series of spaced apart tubes 118 extend through each floor panel 102 under the top surface 104 and between the locking edge 108 and the ramp edge 110. The tubes 118 are sized to accept optional plastic floor supports 130 or wooden floor joists 120 (FIGS. 4–7) to add increased weight capacity and stability to the enclosure 10. The preferred cross-section of the plastic floor support 130 is illustrated in FIG. 4A as generally having an I-beam shape. The plastic floor support is constructed and arranged with the upright portion of the beam split like a Y to allow a fastener to secure the floor support to the floor panel without affecting the strength of the beam. Other suitable cross-sectional shapes well known in the art capable of allowing a fastener to secure the shape to the floor panel could be substituted for the preferred embodiment. Along the locking edge 108 of each bottom panel 102 is a series of spaced apart fingers 122 and recesses 124 for attaching the panels together into a floor assembly 100; each of the fingers being provided with at least one countersank aperture for receiving a fastener (not shown). The fingers 122 and recesses 124 are constructed and arranged so that the fingers 122 overlap and mateably engage the recesses 124 and the fasteners secure the panels together in an inter-fitting engagement with their respective top surfaces 104 in a coplanar arrangement. The bottom surface 106 (FIG. 6) illustrates the cross-bracing 128 facilitated by injection molding of panels. Injection molding offers significant strength and stability advantages over blow-molding as utilized in the prior art. In this manner the enclosure of the instant invention is capable of handling a significant amount of weight as compared to blow molded or extruded enclosures.

Figure 9:
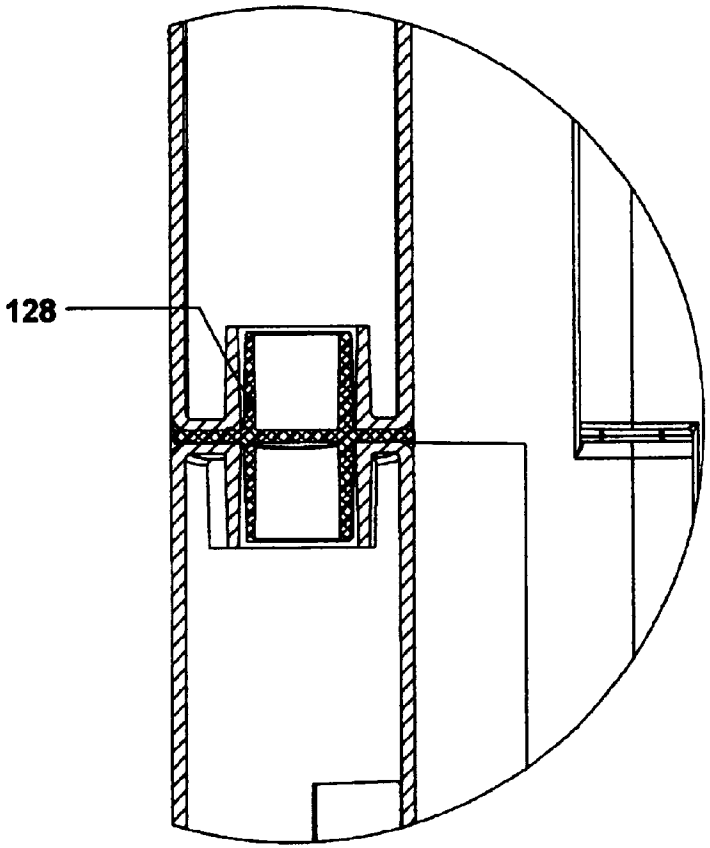
FIG. 9 is a partial cross sectional view illustrating the locking engagement between the dowel and adjacent wall panels.
Figure 23:
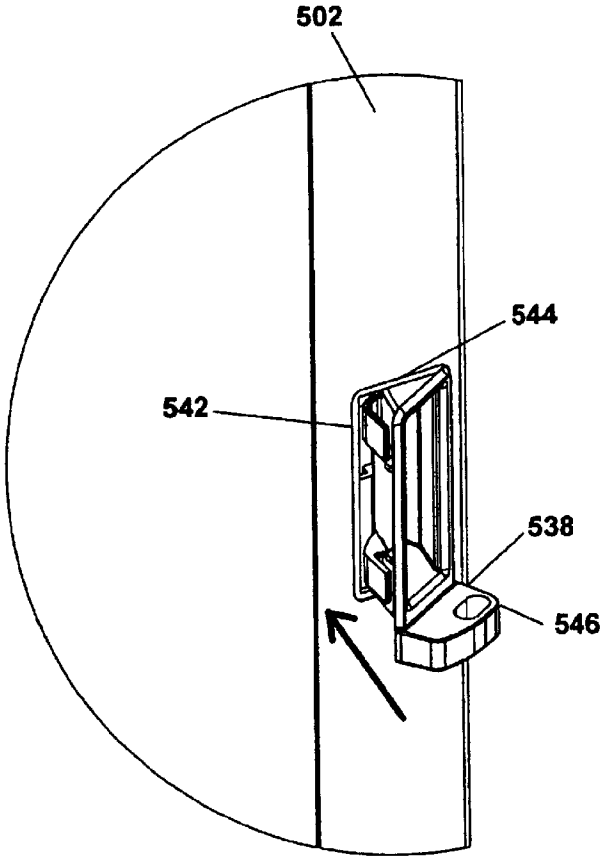
FIG. 23 is a partial view illustrating assembly of one of the door handles utilized in the instant invention.

Referring to FIGS. 7–9, a structural side wall panel 202 is shown. The structural side wall panel 202 constitutes one of a plurality of like-configured panels in the system used to construct the left and right side wall assemblies 200. The structural side wall panels 202 are each configured having a first longitudinal end 208 including an integrally formed attachment means illustrated as a plurality of sockets 210. A second longitudinal end 212 also includes an integrally formed attachment means also illustrated as a plurality of sockets 210. The sockets are generally constructed and arranged to cooperate with either a floor assembly 100 or a roof assembly 400. To facilitate mechanical connection with other inverted first structural panel members 200 in a co-planar relationship the panels are provided a first horizontal edge 214 constructed with an attachment means illustrated as a semi-circular conduit 216 extending from about the first longitudinal end 208 to about the middle portion of the edge 214. Centrally located within the semi-circular conduit 216 is a generally circular aperture 218 for accepting a dowel 220. The second horizontal edge 222 is constructed generally flat extending inwardly to a depending semi-circular conduit 224, the semi-circular conduit 224 extending from about the mid-portion of the panel to about the second horizontal end 212. The conduit 224 is arranged to cooperate with a rear wall panel member 302 or a door-panel member 502 having a complimentary semi-circular conduit in a perpendicular relationship. Continuing with regard to FIGS. 7–9, the outer surface 228 (FIG. 2) of the panels 202 are constructed generally smooth having a plurality of inwardly bowed surfaces 230 for added strength and aesthetic appearance. The inside of the panel 232 is constructed with a plurality of ribs 204 extending from the first edge 214 across the panel 202 to the second edge 222. Each of the ribs 204 are provided with a plurality of gussets 206 to further strengthen the panel 202. The ribs 204 and gussets 206 increase the structural integrity of the enclosure 10 by preventing the panels 202 from bowing or bending inwardly or outwardly, and thus, adversely affecting the appearance or operation of the enclosure 10. The reinforced ribs also provide support for optional shelves 600 (FIG. 23). The construction of the ribs 204 allows shelving to extend across the span of the shed; thereby dividing the load between two walls and eliminating the cantilever effect of attaching a shelf to a single wall surface.

The side wall panels 202 are attached to the interconnected floor panels 102 by sliding either of the first or second longitudinal ends 208, 212 over a plurality of the interlocking posts 116. After locking the first panel into place, each corresponding panel is rotated 180° in relation to the prior panel and slid into place. The sockets 210 in each end of the panels 202 correspond in shape and size to that of the interlocking posts 116 and spring tabs 126 (FIG. 3) integrally formed into the interlocking posts 116 and align with apertures 234 in the sockets 210 to engage the side wall panels 202. The result is a positive mechanical connection between the wall panels 200 and the floor assembly 100 with the first wall panel being attached to the floor assembly 100 with the first longitudinal end 208 downward. The second panel is thereafter attached inverted from the first with the second longitudinal end 212 downward (FIG. 8). Secured to the longitudinal end 212 of the conduit 224 of the first panel is a hinge pin receiver 236 constructed and arranged to cooperate with a roof assembly hinge pin 428 to allow rotational movement of the door assembly 500. Secured to the longitudinal end 212 of the conduit 224 of the second panel is a hinge pin connector 238 constructed and arranged to cooperate with a floor assembly hinge pin 128 (FIG. 3).

It will be appreciated that the purpose of the semi-circular conduits 216, 224 are to align two panels in a co-planar or perpendicular relationship and to facilitate their mechanical connection via the dowel 220. The semi-circular conduits 216, 224 are brought into an overlapping relationship wherein a dowel pin 220 enters the corresponding aperture 218 in each conduit (FIG. 7A). The result is a mechanically secure connection between the two panels (FIG. 9). The overlapping edges between the panels as described above provide a secure connection and offer several advantages. First, the design allows the panels to be connected without the need for I-beam connectors. Second, the design allows the panels to be formed at sufficient height for a walk-in enclosure by creating a positive lock that prevents separation of the panels. Third, the design maintains alignment of the panels in the same plane and prevents bowing or bending of either panel relative to one another. The resultant wall created by the interlocking wall-panels benefits from high structural integrity and reliable operation.

Figure 11:
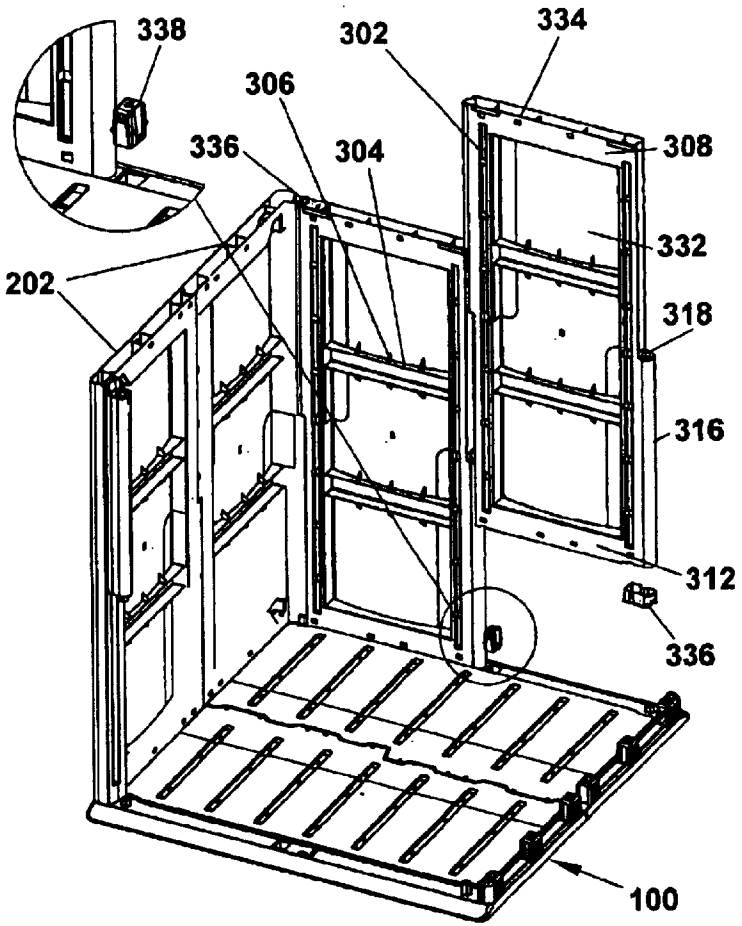
FIG. 11 is a partial perspective view further illustrating assembly of the rear wall panels.
Figure 10:
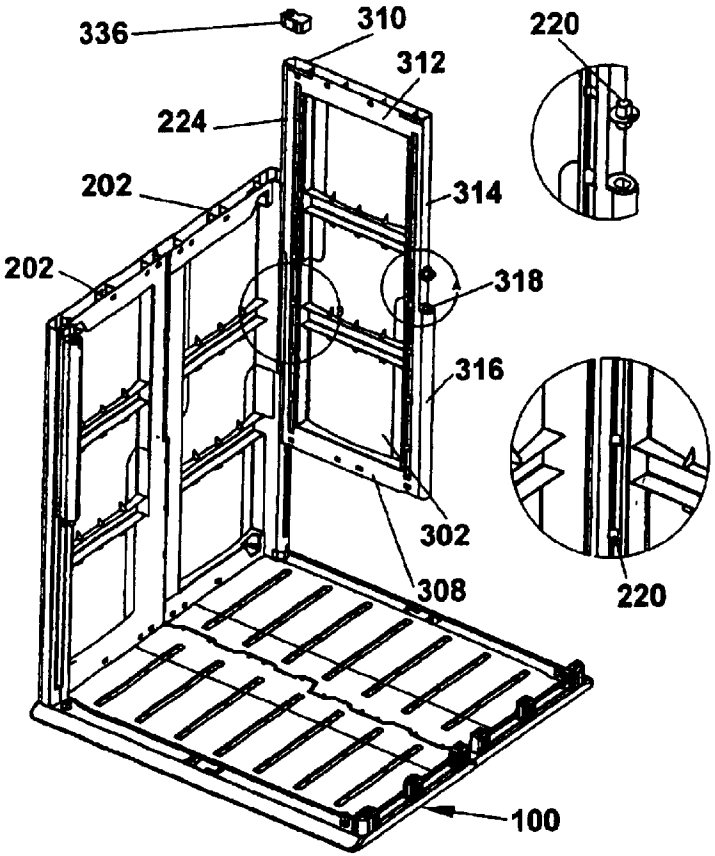
FIG. 10 is a partial perspective view illustrating assembly of the rear wall panels.

Referring to FIGS. 10–11, assembly of the structural rear wall panels is shown. The rear wall panel 302 constitutes one of a plurality of like-configured panels in the system used to construct the rear wall assembly. The rear wall panels 302 are each configured having a first longitudinal end 308 including an integrally formed attachment means illustrated as a plurality of sockets 310. A second longitudinal end 312 includes an integrally formed attachment means also illustrated as a plurality of sockets 310. The sockets are generally constructed and arranged to cooperate with either a floor assembly 100 or a roof assembly 400. To facilitate mechanical connection with other inverted wall panel members 300 in a coplanar or perpendicular relationship, the panels are provided a first horizontal edge 314 constructed with a semi-circular conduit 316 extending from about the first longitudinal end 308 to about the middle portion of the edge. Centrally located within the semi-circular conduit 316 is a generally circular aperture 318 for accepting a dowel 220. The second horizontal edge 322 is constructed generally the same as the first horizontal edge 314 with the exception that the semi-circular conduit 324 extends from about the mid-portion of the panel to the second horizontal end 312. The conduits 316, 324 are arranged to cooperate with other panel members having a complimentary semi-circular conduit in a co-planar or a perpendicular relationship. Hinge cap 336 is constructed and arranged to cooperate with the longitudinal end of the semi-circular conduits and a roof assembly or floor assembly hinge pin 428.

Continuing with regard to FIGS. 10–11, the outer surface 328 (FIG. 2) of the panels 302 are constructed generally smooth having a plurality of inwardly bowed surfaces 330 (FIG. 2) for added strength and aesthetic appearance. The inside of the panel 332 is constructed with a plurality of ribs 304 extending from the first edge 314 across the panel 302 to the second edge 322, each of the ribs 304 are provided with a plurality of gussets 306 to further strengthen the panel 302. The ribs 304 and gussets 306 increase the structural integrity of the enclosure 10 by preventing the panels 302 from bowing or bending inwardly or outwardly and thus, adversely affecting the appearance or operation of the enclosure 10.

The rear panels 302 are attached to the interconnected floor panels 102 and the installed left side panels 202 by sliding the first longitudinal end 308 of a rear wall panel downward over a dowel 220 and aligning the semi-circular conduits. A hinge cap 336 is pushed into a corresponding cavity located in the second longitudinal end 312 of the panel 302 for engagement with the roof assembly 400. The second rear panel is slid downward simultaneously engaging the inserted interlocking post 338 and the hinge pin in the floor assembly via a hinge cap 336 inserted into the semi-circular conduit and engaging the first rear panel via the dowel 220. Spring tabs 126 integrally formed into the inserted interlocking post 338 and hinge caps 336 align with apertures 334 in the panels 302 for engagement. The result is a positive mechanical connection between the side panels 200, rear panels 300 and the floor assembly 100.

Figure 13:
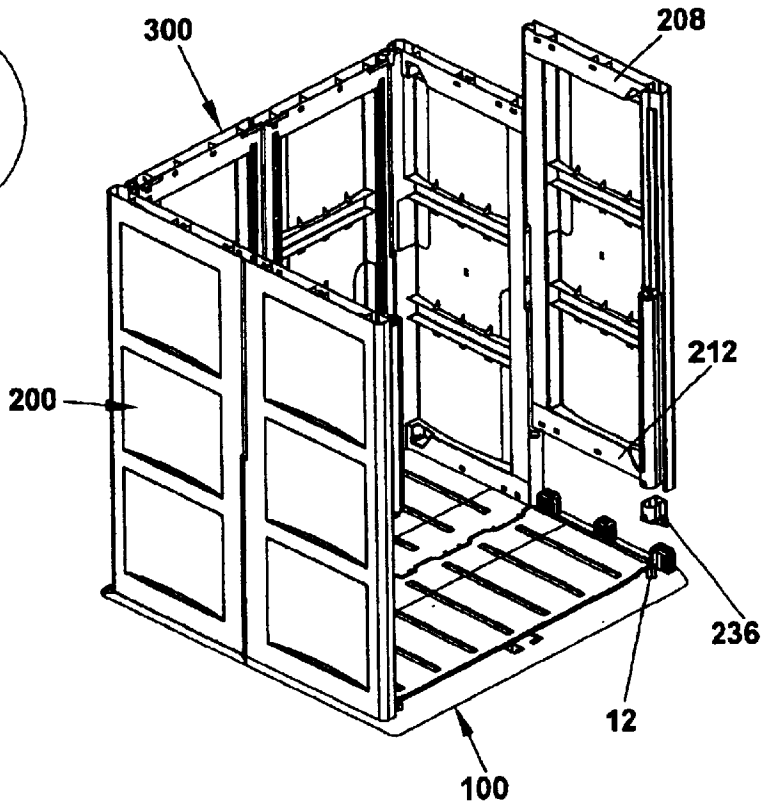
FIG. 13 is a partial perspective view further illustrating assembly of the side wall panels.
Figure 12:
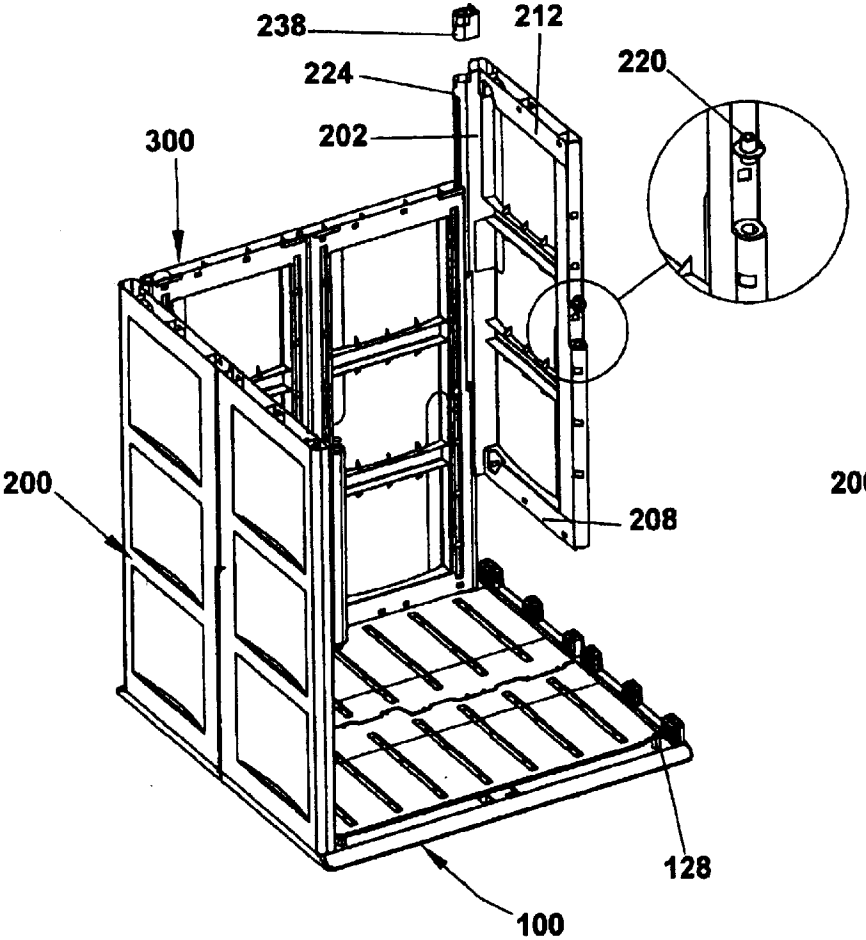
FIG. 12 is a partial perspective view further illustrating assembly of the side wall panels.

Referring to FIGS. 12–13, the first right side wall panel 202 is attached to the interconnected floor panels 102 and the assembled rear wall panels 302 by sliding the first longitudinal end 208 over a plurality of the interlocking posts 116. The second corresponding right side wall panel 202 is rotated 1800 in relation to the first panel 202 and slid into place over the interlocking posts 116 next to the first panel. The sockets 210 in the ends of the panel 202 corresponding in shape and size to that of the interlocking posts 116 and spring tabs 126 (FIG. 3) integrally formed into the interlocking posts 116 align with apertures 234 in the sockets 210 to engage the side wall panel 202 the result is a positive mechanical connection between the wall panels 200 and the floor assembly 100. The first assembled right side wall panel 202 is attached to the floor assembly 100 with the first longitudinal end 208 downward and the second assembled panel is thereafter attached with the second longitudinal end 212 downward (FIG. 13). Secured to the longitudinal end 212 of conduit 224 of the first panel is a hinge pin receiver 238 constructed and arranged to cooperate with a roof assembly hinge pin 428. Secured to the longitudinal end 212 of the conduit 224 of the second panel is a hinge pin connector 236 constructed and arranged to cooperate with a floor assembly hinge pin 128 and the door assembly 500 to allow rotational movement of the doors.

Figure 14:
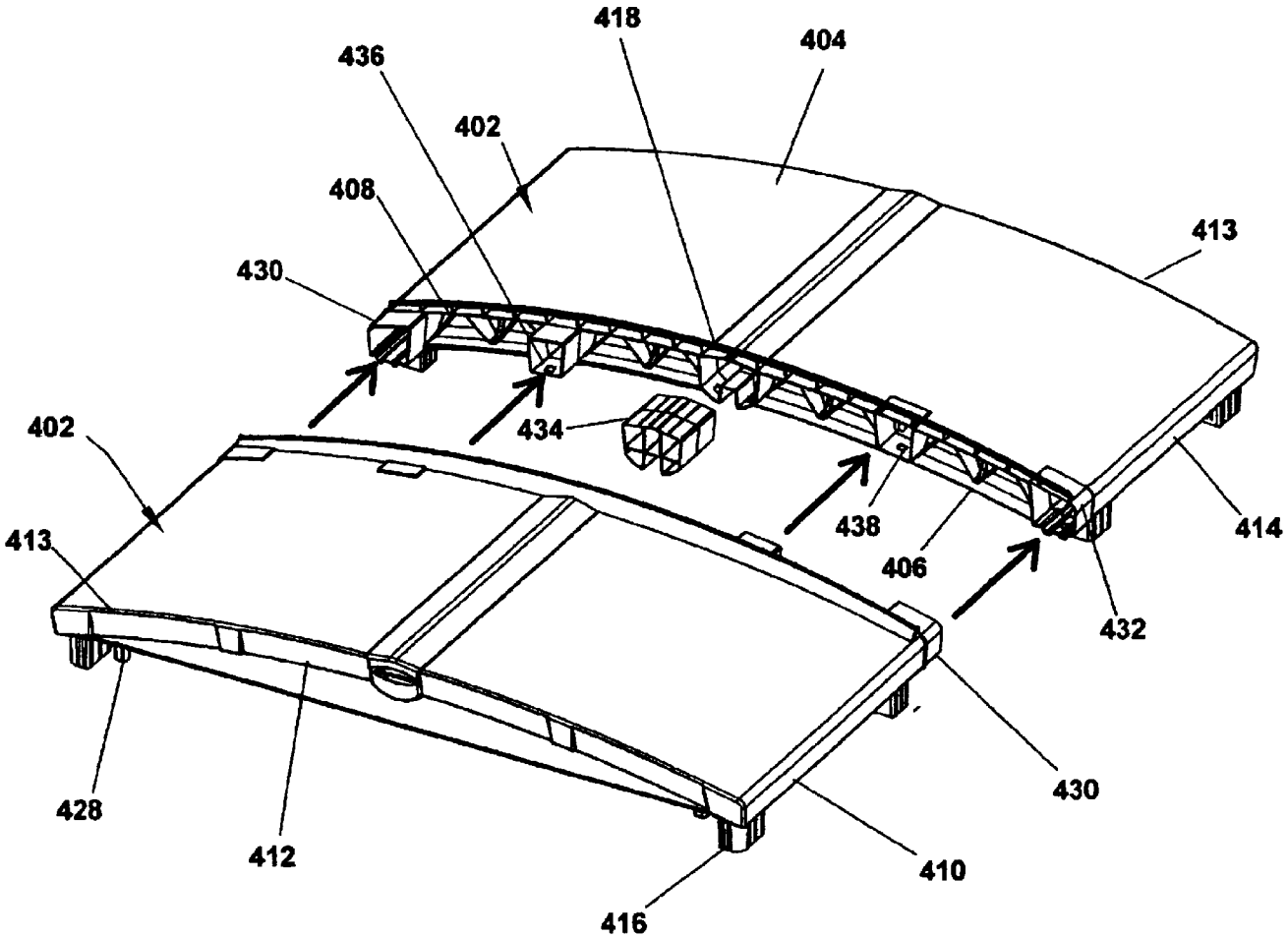
FIG. 14 is a perspective view of the roof panels utilized in the instant invention.
Figure 15:
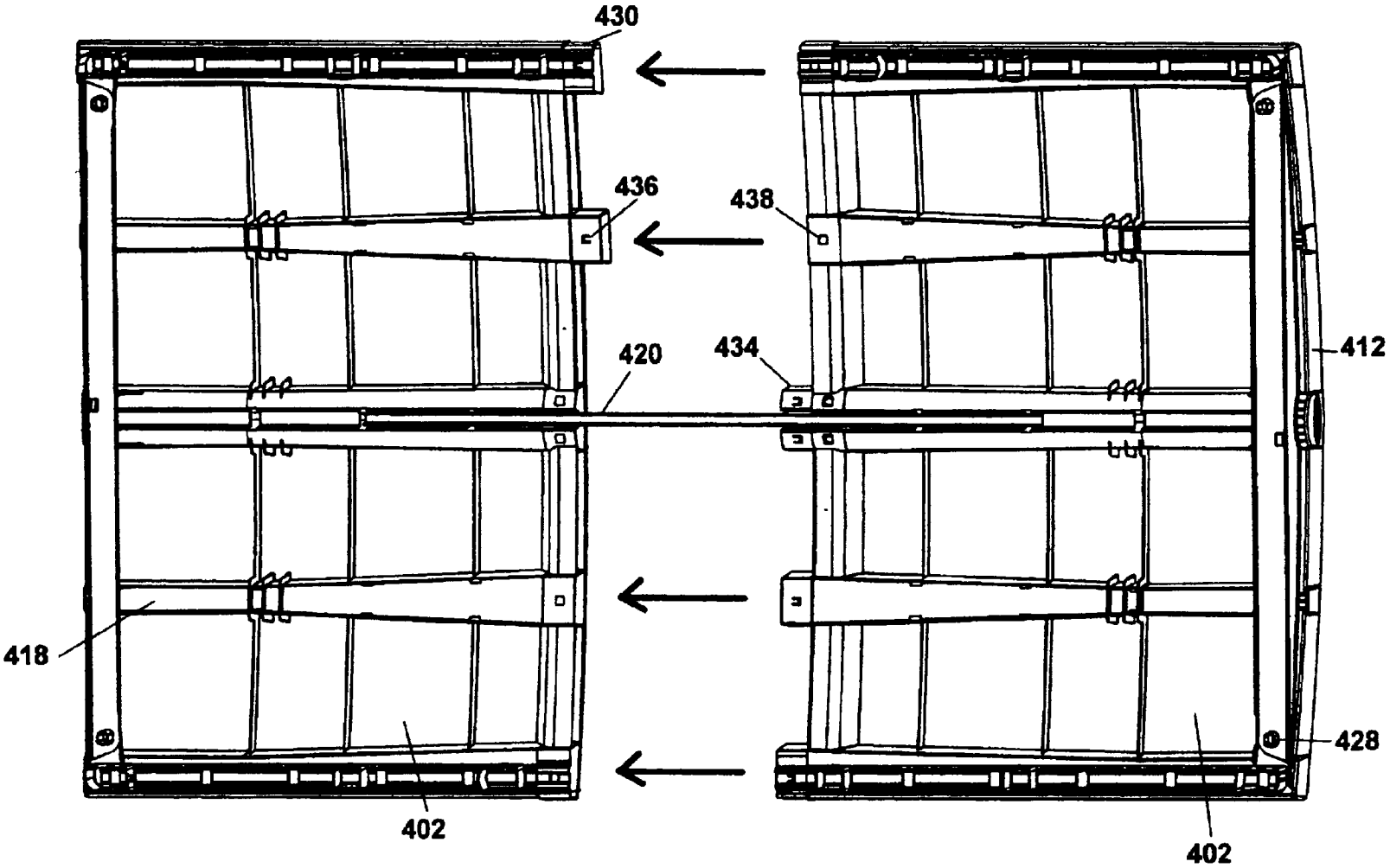
FIG. 15 is a perspective view of the roof panels utilized in the instant invention illustrating insertion of the optional steel roof support.
Figure 16:
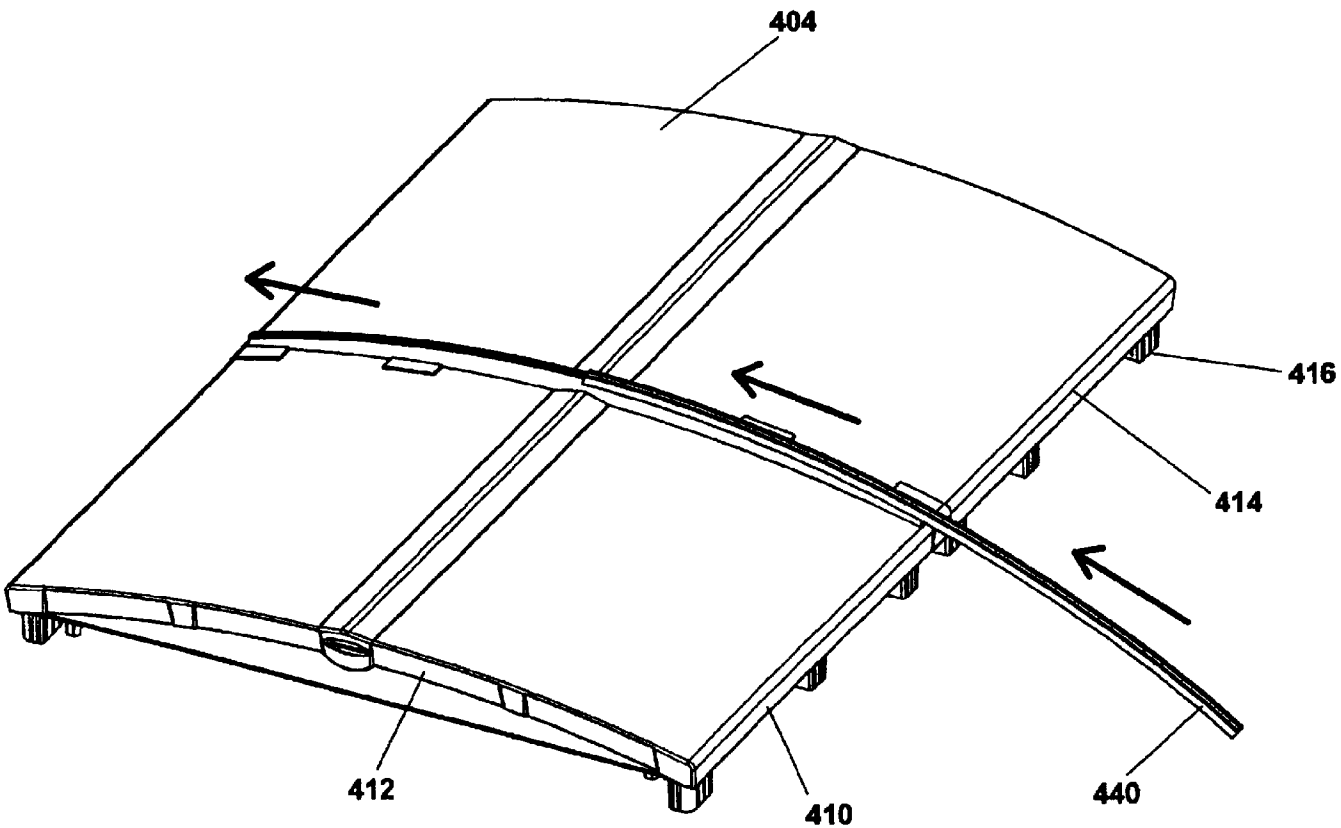
FIG. 16 is a perspective view of the assembled roof panels illustrating insertion of the weatherstrip seal.

Referring to FIGS. 14–16, the enclosure 10 includes a pair of like-constructed roof panels 402. Each panel has a top surface 404, bottom surface 406, locking edge 408 and three closed edges 410, 412 and 414. Closed edge 412 is provided with a drip edge 413 constructed and arranged to to direct water away from the from closed edge 412. Adjacent to the two side closed edges 410, 414 is a plurality of interlocking posts 416 extending downwardly from the top surface 404. The interlocking posts 416 are constructed and arranged to cooperate with sockets 210 located at each longitudinal end of the first structural wall panels 202. A series of spaced apart structural tubes 418 (FIG. 15) extend through each roof panel 402 under the top surface 404 and between the locking edge 408 and the closed edge 412. Along the locking edge 408 of each roof panel 402 a portion of the tubes 418 extend outward from the locking edge to function as interlocking posts 430, the remainder of the tubes being configured as sockets 432 for receiving the interlocking posts 430 for attaching the like-configured panels together into a roof assembly 100. The center tube 418, being constructed and arranged to accept a connector 434 as well as an optional steel roof support 420 (FIG. 15), adds increased weight capacity and stability to the roof assembly 400 of the enclosure 10. The roof panels 402 are slid together until the spring tabs 436 integrally formed into the interlocking posts 430 engage corresponding apertures 438 formed in the sockets 432. A weatherstrip 440 is utilized to seal the roof assembly seam against leakage. Starting at one side of the roof assembly 400, the weather strip 440 is fed into the groove 442 (FIG. 17) formed by connecting the two roof panels 402 until it is centered.

Figure 17:
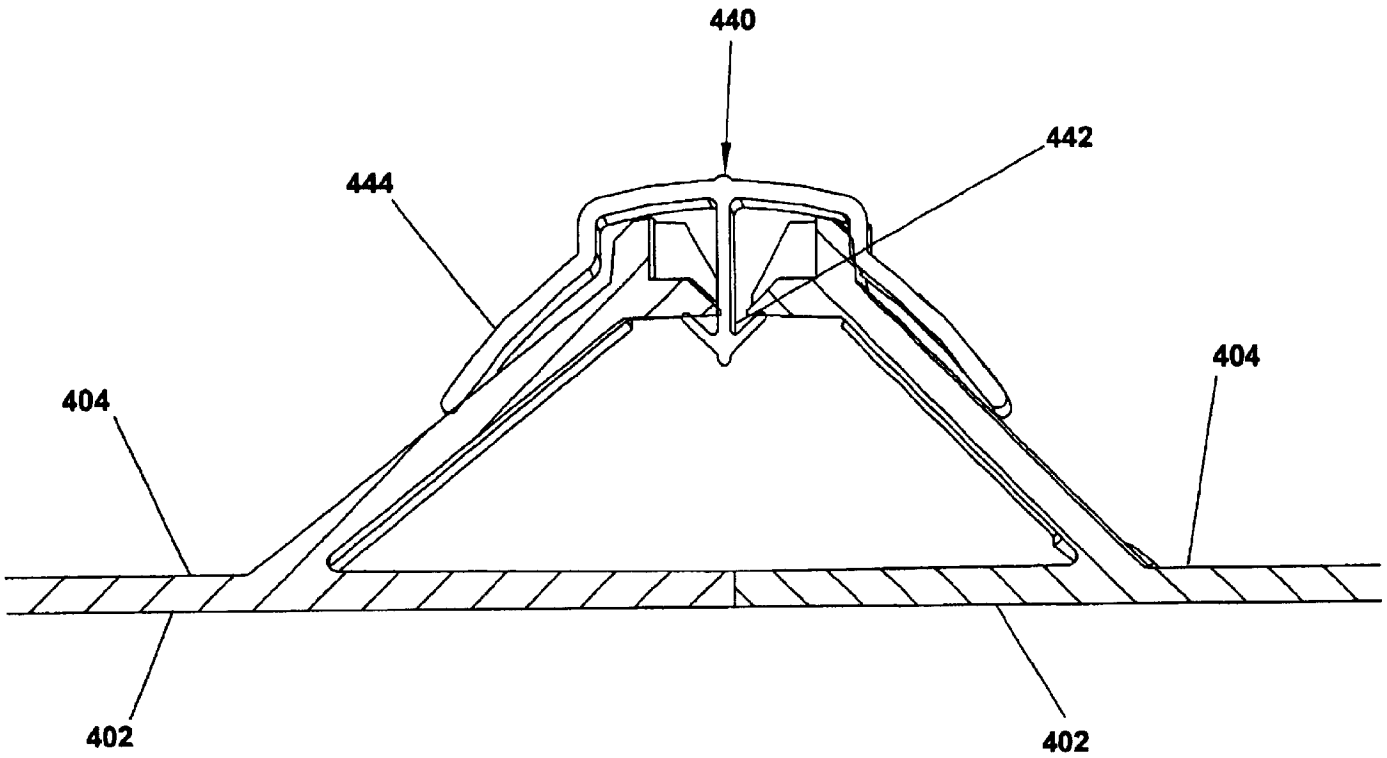
FIG. 17 is a partial cross sectional view illustrating the cooperation between the weatherstrip seal and the roof panels.

FIG. 17 shows the resilient weatherstrip seal 440, which takes the general cross section of a flared U with an arrow extending downwardly from the apex of the radius. The weatherstrip seal 440 is constructed from a resilient material allowing the free edges 444 to be spread outwardly as the strip 440 is slid into place, creating a watertight seal between the top surface 404 of the roof panels 402 and the weatherstrip 440. Moreover, the roof panel 402 construction provides an elevated position for the weatherstrip 440 allowing water to be quickly directed away from the weatherstrip. It is also understood and anticipated that other suitable types of weatherstrips and/or sealants well known in the art could replace the illustrated weatherstrip seal.

Figure 18:
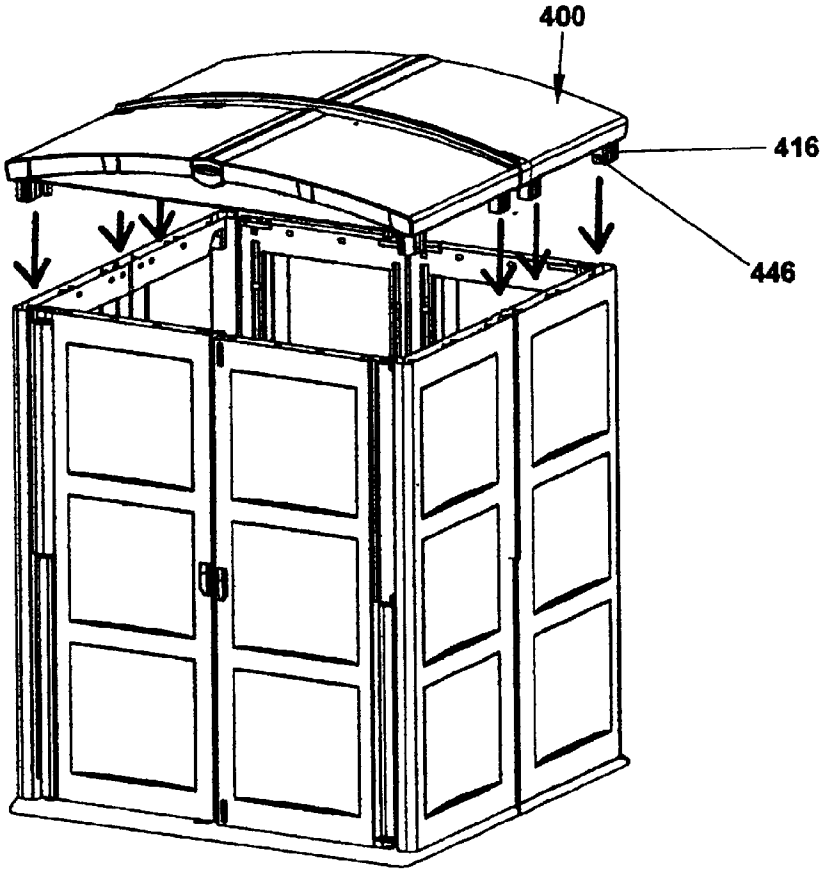
FIG. 18 is a perspective view illustrating installation of the roof assembly.

Assembling the roof assembly onto the enclosure is shown in FIG. 18. It should be appreciated that this step is performed before the doors are assembled to the enclosure. This eliminates the tedious task of aligning the doors as the roof is attached to the structure, thereby simplifying assembly over the prior art. The roof assembly 400 is placed over the assembled left, right, and rear walls and lowered into place. The interlocking posts 416 are lined up with the corresponding sockets 210 in the wall panels 202. The roof assembly 400 is secured in place by pulling downward on the roof until the spring tabs 446 integrally formed into the interlocking posts 416 engage corresponding apertures 234 formed in the sockets 210 and back panel tabs (not shown) interlock with the roof assembly 400. The result is a positive mechanical connection between the side panels 200, rear panels 300 and the roof assembly 400.

Figure 19:
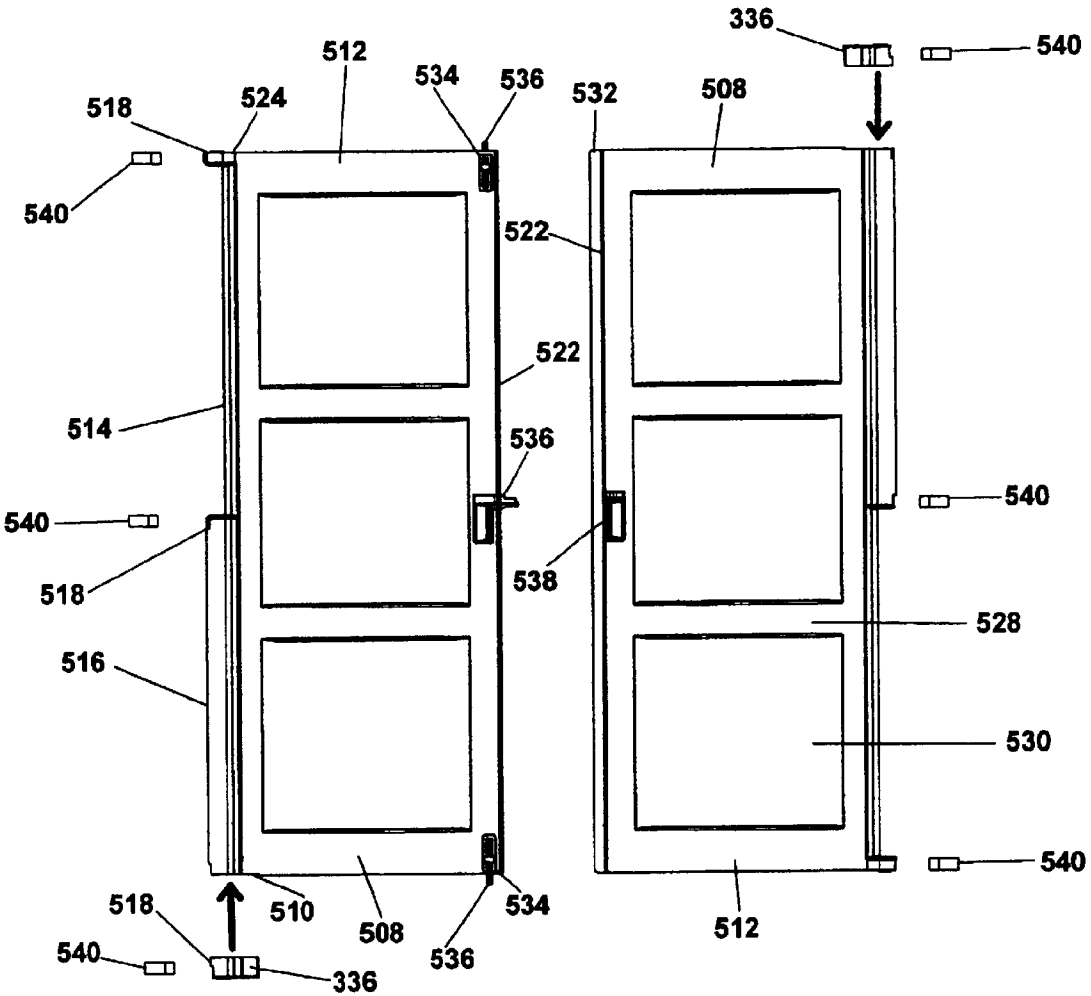
FIG. 19 is a partial exploded view illustrating the door assembly of the instant invention.
Figure 20:
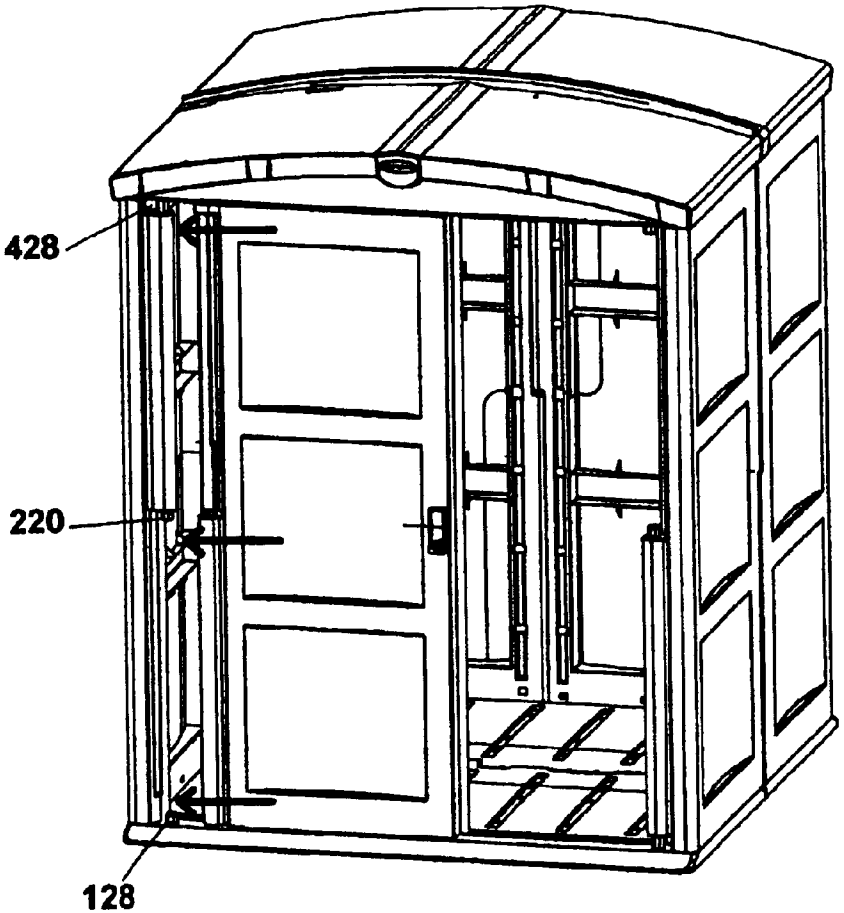
FIG. 20 is a perspective view illustrating the installation of one of the doors.
Figure 21:
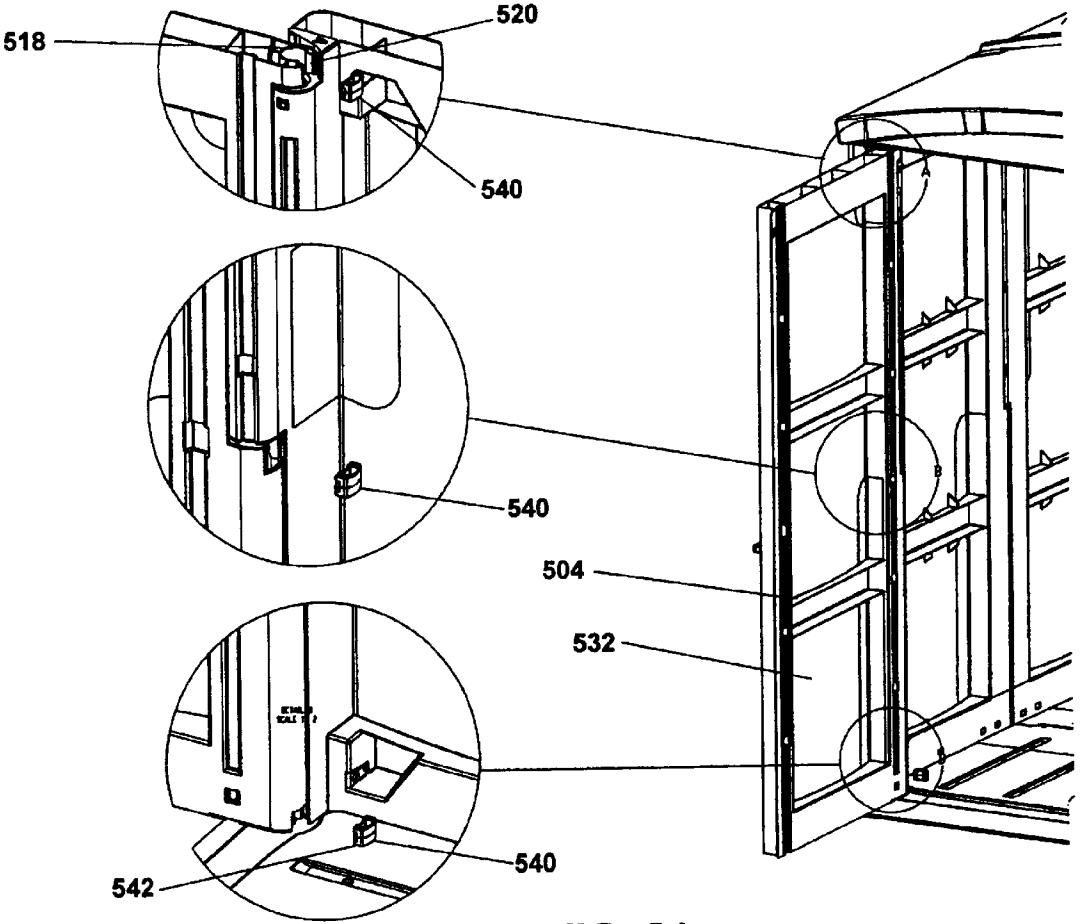
FIG. 21 is a partial perspective view of the enclosure with enlarged partial views illustrating assembly of the hinges.

Referring to FIGS. 19–21, the enclosure includes a door assembly including a pair of door panels, a hinge means, a door handle assembly, and a latch assembly. The door panel 502 constitutes one of a plurality of like-configured panels in the system used to construct the door assembly. The door panels 502 are configured each having a first longitudinal end 508 including at least one integrally formed socket 510. The socket 510 is generally constructed and arranged to cooperate with a hinge cap 336 having a C-shaped annular portion. The door panels are also configured having a second longitudinal end 512 including an integrally formed C-shaped annular hinge portion 524. To facilitate mechanical connection with other side wall panel members 200 in a hinging relationship, the panels are provided a first horizontal edge 514 constructed with a semi-circular conduit 516 extending from about the first longitudinal end 508 to about the middle portion of the edge. The hinge cap 336, integrally formed hinge portion 524, and the semi-circular conduit 516 each contain at least one hinge means illustrated as a C-shaped annular portion 518 having an open side 520 constructed and arranged to accept a hinge pin 128, 428 or a dowel pin 220 and to cooperate with a hinge clip 540 to close the annular cavity 518 and allow pivoting movement of the door panel 502. The second horizontal edge 522 is constructed generally flat with the exception of a optional ledge 532 extending the full length of the panel. The optional ledge 532 may be attached by any suitable fastening means well known in the art or may be integrally formed with the panel. The door panels 502 are also provided with an upper and lower sliding latch mechanism 534 and left and right door handles 536, 538.

Continuing with regard to FIGS. 19–21, the outer surface 528 of the panels 502 are constructed generally smooth having a plurality of inwardly bowed surfaces 530 for added strength and aesthetic appearance. The inside of the panel 532 is constructed with a plurality of ribs 504 extending from the first edge 514 across the panel 502 to the second edge 522. Each of the ribs 504 may be provided with a plurality of gussets (not shown) to further strengthen the panel 502. The ribs 504 increase the structural integrity of the enclosure 10 by preventing the panels 502 from bowing or bending, inwardly or outwardly, and thus, adversely affecting the appearance or operation of the enclosure 10.

The door panels 502 are attached to the interconnected floor panels 100, left and right side wall assemblies 200, and roof panels 400 by sliding the respective hinge cap 336 into the corresponding cavity 510 located in the first end 508 of the door panels, the second door panel being rotated 180° in relationship to the first. Either door panel 502 is aligned with the hinge pins by sliding it horizontally into place over the respective pins and engaging the hinge clips 540 (FIGS. 20–21). The body of the hinge clip 540 is generally concave and rectangular and includes spring tabs 542 located at each end adapted to fit within the respective hinge caps to secure the door panels to the hinge pins and facilitate independent rotational movement of each door. It should be appreciated that this construction allows the doors to be installed or removed without disassembling or partially disassembling other components from the enclosure 10. The construction also provides economic advantage allowing inexpensive hinge components to be easily removed and replaced in the event they become damaged while reusing the same panel. The door panels are also provided with removable and replaceable door latching mechanisms including slide latches 534, left door handle 536 and right door handle 538.

Figure 22:
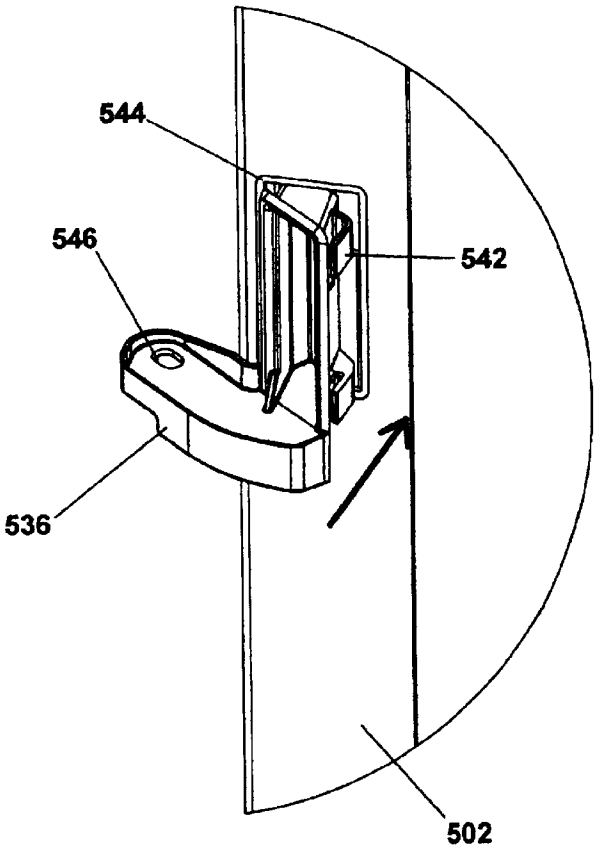
FIG. 22 is a partial view illustrating assembly of one of the door handles utilized in the instant invention.

Referring to FIGS. 22–23, installation of the left door handle 536 and right door handle 538 is illustrated. The door handles are constructed and arranged to allow simple push-in installation. The handles are merely pushed into apertures 544 contained in door panels 502 until the spring clips 542 engage the back surface 532 of panel 502. In this manner the door handles can be installed and removed as need without the need for tools or screw type fasteners. The handles are also provided with lock apertures allowing the contents contained within the enclosure to be secured with a padlock or the like.

Figure 25:
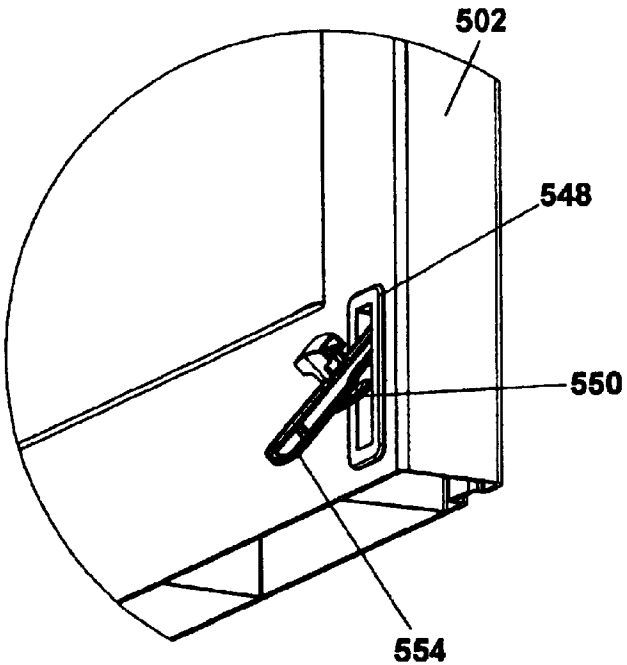
FIG. 25 is a partial view illustrating assembly of one of the door latch pins utilized in the instant invention.
Figure 24:
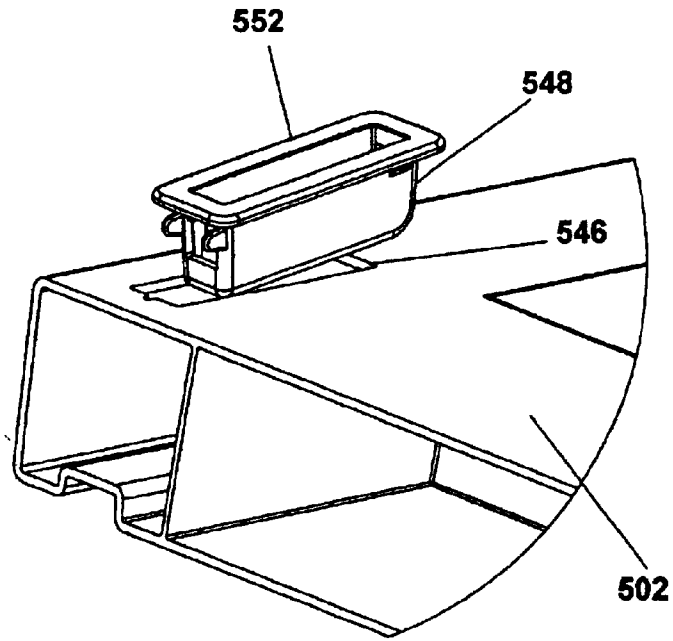
FIG. 24 is a partial view illustrating assembly of one of the door latch housings utilized in the instant invention.
Figure 26:
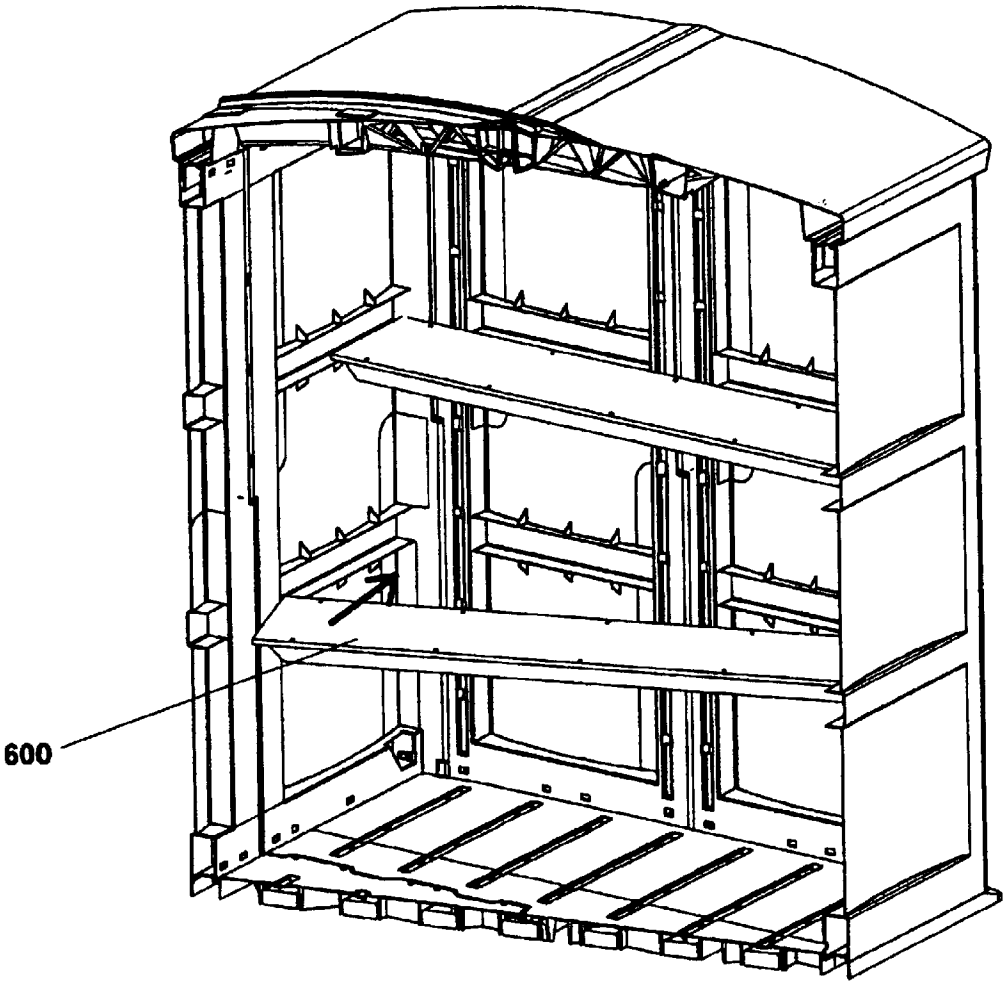
FIG. 26 is a partial sectioned view illustrating the cooperation of the optional shelves with the side panels in the instant invention.

Referring to FIGS. 24–25, installation of the upper and lower door latches is illustrated. The door latches are constructed and arranged to allow simple push-in installation. The latch housings 552 are merely pushed into apertures 546 located adjacent to edge 522 in the door panels 502 until the spring clips 548 engage the back surface 532 of panel 502. Thereafter, the one end of the door latch pin 554 is inserted through the housing 552 and slid downwardly until the spring clip 550 is snapped into place. In this manner the door latches can be installed and removed as needed without the need for tools or screw type fasteners. The latch pin 554 can be slid outwardly to engage the roof assembly 400 or the floor assembly 100 to secure the contents contained within the enclosure 10.

Figure 27:
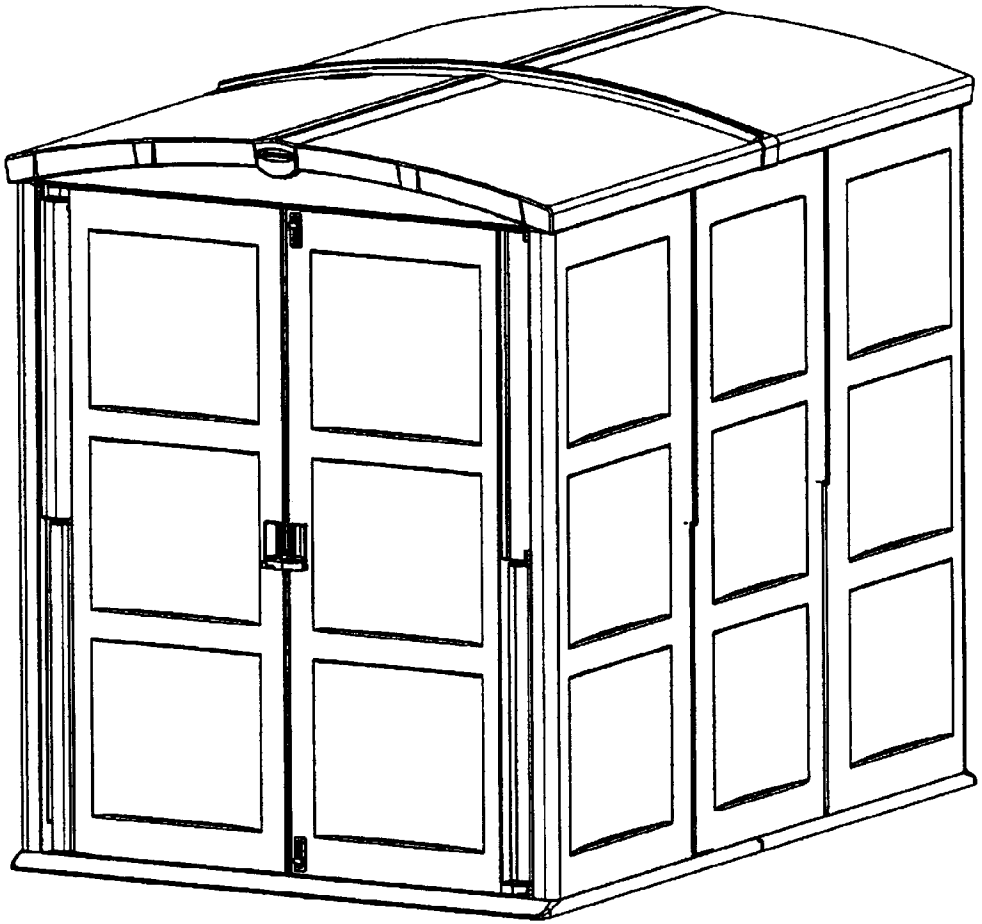
FIG. 27 illustrates an alternative embodiment of the instant invention.
Figure 28:
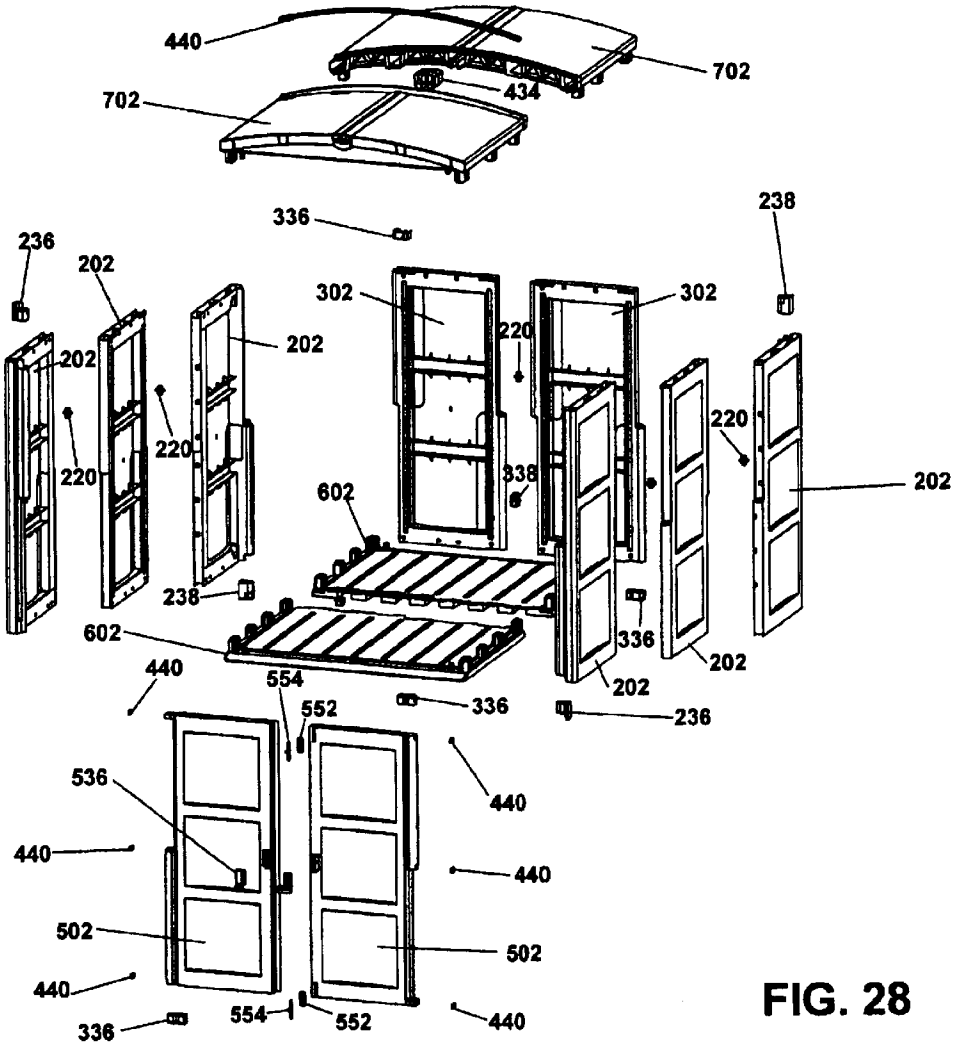
FIG. 28 is an exploded view of the alternative embodiment shown in FIG. 27.

Referring to FIGS. 27–28, an alternative embodiment of the present invention is shown wherein the enclosure is made larger by increasing the size of the floor panels 602, the roof panels 702, and adding a rear wall panel 302 between side wall panels 202. In this manner the same construction can be utilized to build structures of varying size utilizing substantially the same components.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A heavy duty enclosure system comprising:

a bi-laterally symmetrical floor assembly for enclosing the bottom of said heavy duty enclosure;

a pair of bi-laterally symmetrical side wall assemblies for enclosing the left side and right side of said heavy duty enclosure;

a bi-laterally symmetrical rear wall assembly for enclosing the back of said heavy duty enclosure;

a bi-laterally symmetrical door assembly for enclosing and providing ingress into and egress from-said heavy duty enclosure; and a bi-laterally symmetrical roof assembly for enclosing the top of said heavy duty enclosure system;

said bi-laterally symmetrical floor assembly including at least two floor panel members, wherein each of said floor panel members includes a top surface having a means of attaching said floor assembly to said side wall assemblies said rear wall assembly, and said door assembly, a bottom surface constructed and arranged to provide rigidity and stability to said floor assembly, a ramp edge for easy loading and unloading of said heavy duty enclosure, two closed edges for maintaining a weather resistant enclosure, and a locking edge for connecting locking edges of said floor panel members into said floor assembly, wherein each said locking edge includes a series of spaced apart fingers and recesses, said fingers and recesses constructed and arranged so that said fingers overlap and mateably engage said recesses of an adjacent floor panel member in an inter fitting engagement with their respective top surfaces in a co-planar arrangement;

wherein a heavy duty enclosure can be shipped in a disassembled state and assembled on a desired site.

2. The heavy duty enclosure system of claim 1 wherein each of said fingers is provided with at least one countersunk aperture for receiving a fastener, wherein said fasteners secure said floor panel members together in an inter-fitting engagement with their respective top surfaces in a co-planar arrangement.

3. The heavy duty enclosure system of claim 1 wherein said floor panel members include a plurality of spaced apart tubes extending through each said floor panel under said top surface and above said bottom surface and extending between said locking edge and said ramp edge, said tubes being sized to accept wooden floor joists thereby adding increased weight capacity and stability to said enclosure.

4. The heavy duty enclosure system of claim 1 wherein said means of attaching said wall and said door assemblies to said top surface includes a plurality of locking posts arranged in a linear fashion adjacent to said closed edges and extending upwardly from said top surface, said locking posts constructed and arranged to cooperate with said wall assemblies;

wherein said wall assemblies are secured to said floor panels via said locking posts.

5. The heavy duty enclosure system of claim 4 wherein said means of attaching said wall and said door assemblies to said top surface includes at least one hinge pin arranged adjacent to said locking posts and said ramp edge, said hinge pin constructed and arranged to cooperate with said wall assemblies and said door assembly;

wherein said door assembly is allowed to open and close in a pivotal fashion.

6. The heavy duty enclosure system of claim 1 wherein said bottom surface includes integrally formed cross-bracing;

wherein said cross-bracing provides increased weight capacity and stability to said enclosure.

7. The heavy duty enclosure system of claim 1 wherein said side wall assemblies includes at least four like-constructed side wall panel members for constructing a right side wall assembly and a left side wall assembly for said heavy duty enclosure system;

wherein said left side wall assembly includes two of said side wall panels and said right side wall assembly includes two of said side wall panels.

8. The heavy duty enclosure system of claim 7 wherein said wall panel members include a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member in a co-planar relationship, a second horizontal edge constructed generally flat extending inwardly to a depending attachment means constructed and arranged to cooperate with a rear wall panel member or a door panel member in a perpendicular relationship.

9. The heavy duty enclosure system of claim 8 wherein said first longitudinal end attachment means includes at least one integrally formed pocket and said second longitudinal end attachment means includes at least one integrally formed pocket.

10. The heavy duty enclosure system of claim 8 wherein said first horizontal edge attachment means includes a semi-circular conduit extending from about the first longitudinal end to about the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

11. The heavy duty enclosure system of claim 8 wherein said second horizontal edge attachment means includes a semi-circular conduit extending from about the second longitudinal end to about the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

12. The heavy duty enclosure system of claim 1 wherein said bi-laterally symmetrical rear wall assembly includes a pair of like-constructed rear wall panel members, said rear wall panel members having a first longitudinal end with an integral attachment means constructed and arranged to cooperate with a floor assembly or a roof assembly, a second longitudinal end having an attachment means constructed and arranged to cooperate with said roof or said floor assemblies, a first horizontal edge having an attachment means constructed and arranged to cooperate with at least one panel member, a second horizontal edge having an attachment means constructed and arranged to cooperate with at least one panel member.

13. The heavy duty enclosure system of claim 12 wherein said first horizontal edge attachment means includes a semi-circular conduit extending from about said first longitudinal end to about the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

14. The heavy duty enclosure system of claim 12 wherein said second horizontal edge attachment means includes a semi-circular conduit extending from about said second longitudinal end to about the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters said circular apertures in each conduit resulting in a mechanically secure connection between the two said panels.

15. The heavy duty enclosure system of claim 1 wherein said bi-laterally symmetrical roof assembly includes a pair of like-constructed roof panels each panel having a top surface, a bottom surface, a locking edge, and three closed edges.

16. The heavy duty enclosure system of claim 15 wherein said bottom surface includes a plurality of locking posts extending downwardly, said locking posts arranged in a linear fashion adjacent to said closed edges and extending downwardly from said bottom surface, said locking posts constructed and arranged to cooperate with said wall assemblies;

wherein said wall assemblies are secured to said floor panels via said locking posts.

17. The heavy duty enclosure system of claim 15 wherein said roof assembly includes a plurality of spaced apart structural tubes extending through each roof panel under said top surface and between said locking edge and said closed edge.

18. The heavy duty enclosure system of claim 17 wherein at least one of said tubes is constructed and arranged to extend outward from said locking edge to function as a locking post and at least one of said tubes is constructed and arranged as a socket for receiving said at least one locking post for attaching said like-configured roof panels together into said roof assembly.

19. The heavy duty enclosure system of claim 17 wherein at least one of said tubes is constructed and arranged as a socket to accept a connector tube, said at least one tube and said connector tube constructed and arranged to accept a steel roof support for adding increased weight capacity and stability to said roof assembly of said enclosure.

20. The heavy duty enclosure system of claim 17 wherein said roof assembly include a weatherstrip seal for creating a watertight seal between said bi-symmetrical roof panels.

21. The heavy duty enclosure system of claim 1 wherein said bi-laterally symmetrical door assembly includes a pair of like-constructed door panels each having a first longitudinal end including at least one integrally formed socket, said socket constructed and arranged to cooperate with a hinge means, a second longitudinal end including an integrally formed hinge means, a first horizontal edge having a semi-circular conduit extending from about said first longitudinal end to about the middle portion of said edge said conduit having an integrally formed hinge means, a second horizontal edge being generally flat.

22. The heavy duty enclosure system of claim 21 wherein said hinge means includes a C-shaped annular portion for accepting a hinge pin, said C-shaped annular portion constructed and arranged to cooperate with a hinge clip to close said annular portion and allow pivoting movement of said door panels;

wherein said C-shaped hinge means allows said door panels to be assembled to said enclosure without partial disassembly of other portions of said enclosure.

23. A heavy duty enclosure system comprising:

a pair of bi-laterally symmetrical side wall assemblies for enclosing the left side and right side of said heavy duty enclosure;

a bi-laterally symmetrical rear wall assembly for enclosing the back of said heavy duty enclosure;

a bi-laterally symmetrical door assembly for enclosing and providing ingress into and egress from said heavy duty enclosure;

a bi-laterally symmetrical roof assembly for enclosing the top of said heavy duty enclosure system;

a bi-laterally symmetrical floor assembly for enclosing the bottom of said heavy duty enclosure, said bi-laterally symmetrical floor assembly including at least two floor panel members, wherein each of said floor panel members includes, a top surface having a means of attaching said floor assembly to said side wall assemblies, said rear wall assembly, and said door assembly, a bottom surface, wherein said floor panel members include a plurality of spaced apart tubes extending through each said floor panel under said top surface and above said bottom surface and extending between said locking edge and said ramp edge, said tubes being sized to accept wooden floor joists thereby adding increased weight capacity and stability to said enclosure, a ramp edge for easy loading and unloading of said heavy duty enclosure, two closed edges for maintaining a weather resistant enclosure, and a locking edge for connecting locking edges of said floor panel members into said floor assembly;

wherein said heavy duty enclosure can be shipped in a disassembled state and assembled on a desired site.

24. A heavy duty enclosure system comprising:

a bi-laterally symmetrical floor assembly for enclosing the bottom of said heavy duty enclosure;

a pair of bi-laterally symmetrical side wall assemblies for enclosing the left side and right side of said heavy duty enclosure, said right side wall assembly including at least two like-constructed side wall panel members and said left side wall assembly including at least two like-constructed side wall panels members, each said wall panel member including, a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge including a semi-circular conduit extending from about the first longitudinal end to about the middle portion of said edge, said conduit having a generally circular aperture for accepting a dowel centrally located within said middle portion end of said semi-circular conduit, wherein said semi-circular conduit is brought into an overlapping relationship with a corresponding semi-circular conduit and a dowel pin enters said circular apertures in each conduit resulting in a mechanically secure connection between the two said panels, a second horizontal edge constructed generally flat extending inwardly to a depending attachment means constructed and arranged to cooperate with a rear wall panel member or a door panel member in a perpendicular relationship;

a bi-laterally symmetrical rear wall assembly for enclosing the back of said heavy duty enclosure;

a bi-laterally symmetrical door assembly for enclosing and providing ingress into and egress from said heavy duty enclosure;

a bi-laterally symmetrical roof assembly for enclosing the top of said heavy duty enclosure system;

wherein a heavy duty enclosure can be shipped in a disassembled state and assembled on a desired site.

25. A heavy duty enclosure system comprising:

a bi-laterally symmetrical floor assembly for enclosing the bottom of said heavy duty enclosure;

a pair of bi-laterally symmetrical side wall assemblies for enclosing the left side and right side of said heavy duty enclosure, said right side wall assembly including at least two like-constructed side wall panel members and said left side wall assembly including at least two like-constructed side wall panels members, each said wall panel member including, a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member in a co-planar relationship, a second horizontal edge constructed generally flat extending inwardly to a depending attachment means, said attachment means including a semi-circular conduit extending from about the second longitudinal end to about the middle portion of said edge, said conduit having a generally circular aperture for accepting a dowel centrally located within said middle portion end of said semi-circular conduit, wherein said semi-circular conduit is brought into an overlapping relationship with a corresponding semi-circular conduit and a dowel pin enters said circular apertures in each conduit resulting in a mechanically secure connection between the two said panels;

a bi-laterally symmetrical rear wall assembly for enclosing the back of said heavy duty enclosure;

a bi-laterally symmetrical door assembly for enclosing and providing ingress into and egress from said heavy duty enclosure;

a bi-laterally symmetrical roof assembly for enclosing the top of said heavy duty enclosure system;

wherein a heavy duty enclosure can be shipped in a disassembled state and assembled on a desired site.

26. A heavy duty enclosure system comprising:

a bi-laterally symmetrical floor assembly for enclosing the bottom of said heavy duty enclosure;

a pair of bi-laterally symmetrical side wall assemblies for enclosing the left side and right side of said heavy duty enclosure;

a bi-laterally symmetrical rear wall assembly for enclosing the back of said heavy duty enclosure;

a bi-laterally symmetrical door assembly for enclosing and providing ingress into and egress from said heavy duty enclosure;

a bi-laterally symmetrical roof assembly for enclosing the top of said heavy duty enclosure system, said roof assembly including at least two roof panels each said panel including a plurality of spaced apart structural tubes extending through each roof panel under said top surface and between said locking edge and said closed edge, wherein at least one of said tubes is constructed and arranged to extend outward from said locking edge to function as a locking post and at least one of said tubes is constructed and arranged as a socket for receiving said at least one locking post for attaching said like-configured roof panels together into said roof assembly.

27. The heavy duty enclosure system of claim 26 wherein at least one of said spaced apart structural tubes is constructed and arranged to accept a steel roof support for adding increased weight capacity and stability to said roof assembly of said enclosure.

* * * * *